US012044089B2

(12) United States Patent
Shirani et al.

(10) Patent No.: US 12,044,089 B2
(45) Date of Patent: Jul. 23, 2024

(54) SYSTEM AND METHOD FOR INSTALLING OR RETRIEVING A PRESSURE CAP ASSEMBLY

(71) Applicant: ONESUBSEA IP UK LIMITED, London (GB)

(72) Inventors: Alireza Shirani, Houston, TX (US); Curtis Sifford, San Antonio, TX (US); Gustavo Gonzalez, Cypress, TX (US); Adele Perrier, Houston, TX (US); Thomas Wertz, Houston, TX (US); Ted Mercer, Cypress, TX (US)

(73) Assignee: ONESUBSEA IP UK LIMITED, London (GB)

( * ) Notice: Subject to any disclaimer, the term of this patent is extended or adjusted under 35 U.S.C. 154(b) by 56 days.

(21) Appl. No.: 18/049,480

(22) Filed: Oct. 25, 2022

(65) Prior Publication Data

US 2024/0133260 A1 Apr. 25, 2024

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 33/035; E21B 33/038; E21B 41/00; E21B 43/013
See application file for complete search history.

(56) References Cited

U.S. PATENT DOCUMENTS 4,019,334 A * 4/1977 Sinclair ..... F16L 37/002 29/237
6,024,514 A 2/2000 Ostergaard
6,474,416 B2 11/2002 Beall
6,615,923 B1 9/2003 Lay, Jr.
6,997,645 B2 * 2/2006 von Trepka ..... F16L 1/26 405/169

(Continued)

FOREIGN PATENT DOCUMENTS

CN 110671072 A 1/2020
KR 102150925 B1 * 9/2020

(Continued)

OTHER PUBLICATIONS

Search Report and Written Opinion of International Patent Application No. PCT/US2023/035857 dated Feb. 15, 2024, 10 pages.

*Primary Examiner* — Daniel P Stephenson
(74) *Attorney, Agent, or Firm* — Jeffrey D. Frantz

(57) ABSTRACT

A system includes a running tool having a carrier with an axial drive, an arm coupled to the axial drive, and a tool engagement bracket coupled to the arm. The tool engagement bracket is configured to couple to a pressure cap assembly having a clamp assembly disposed about a pressure cap. The tool engagement bracket includes a torque tool opening configured to enable engagement of a torque tool with the clamp assembly. The axial drive is configured to move the arm, the tool engagement bracket, and the pressure cap assembly along an axial path of travel along a central axis of the pressure cap. The system has at least one of: the running tool is configured to install or remove the pressure cap assembly within a window of a hydrocarbon system having first and second fluid systems removably coupled together, or the running tool is configured to removably couple to the pressure cap assembly.

19 Claims, 11 Drawing Sheets

(56) References Cited

U.S. PATENT DOCUMENTS

| | | | | |
|---|---|---|---|---|
| 7,086,807 | B2 * | 8/2006 | Mackinnon | F16L 1/26 166/347 |
| 9,222,338 | B2 * | 12/2015 | Larsson | E21B 43/0107 |
| 2011/0005764 | A1 * | 1/2011 | Bekkevold | E21B 43/013 166/344 |
| 2012/0097259 | A1 | 4/2012 | Baltimore | |
| 2013/0220628 | A1 * | 8/2013 | Tran | E21B 34/101 166/368 |
| 2014/0102711 | A1 | 4/2014 | Hestetun | |
| 2015/0204167 | A1 * | 7/2015 | Skeels | E21B 49/001 166/344 |
| 2019/0055822 | A1 * | 2/2019 | Cargol, Jr. | E21B 19/002 |
| 2021/0025264 | A1 | 1/2021 | Shirani et al. | |
| 2022/0018465 | A1 * | 1/2022 | Bastesen | F16L 23/006 |

FOREIGN PATENT DOCUMENTS

| | | | | |
|---|---|---|---|---|
| WO | WO-2006005994 | A1 * | 1/2006 | E21B 43/013 |
| WO | WO-2008012134 | A1 * | 1/2008 | E21B 43/0107 |
| WO | WO-2009082240 | A1 * | 7/2009 | E21B 43/013 |
| WO | WO-2013160686 | A2 * | 10/2013 | E21B 33/035 |
| WO | 2018217099 | A1 | 11/2018 | |

* cited by examiner

SYSTEM AND METHOD FOR INSTALLING OR RETRIEVING A PRESSURE CAP ASSEMBLY

BACKGROUND

The present disclosure relates generally to a system and method for installing and removing a pressure cap assembly of a hydrocarbon system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons) may be extracted from subsurface reservoirs and transported to the surface for commercial sales, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

In certain applications, it may be desirable to couple a pressure cap assembly to a hub of a fluid system, such as a horizontal fluid conduit system, of a hydrocarbon system. Unfortunately, a typical pressure cap assembly consumes considerable space, which complicates the installation or removal of the pressure cap assembly in tight spaces. For example, if two hubs (e.g., inboard and outboard hubs) are arranged in close proximity to one another, then it may not be possible to install or remove the typical pressure cap assembly without moving outboard equipment. Accordingly, a need exists for an improved pressure cap assembly and an improved running tool.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with certain embodiments, a system includes a running tool having a carrier with an axial drive, an arm coupled to the axial drive, and a tool engagement bracket coupled to the arm. The tool engagement bracket is configured to couple to a pressure cap assembly having a clamp assembly disposed about a pressure cap. The tool engagement bracket includes a torque tool opening configured to enable engagement of a torque tool with the clamp assembly. The axial drive is configured to move the arm, the tool engagement bracket, and the pressure cap assembly along an axial path of travel along a central axis of the pressure cap. The system has at least one of: the running tool is configured to install or remove the pressure cap assembly within a window of a hydrocarbon system having first and second fluid systems removably coupled together, or the running tool is configured to removably couple to the pressure cap assembly.

In accordance with certain embodiments, a system includes a hydrocarbon system having a first fluid system with a first tubing connector having a first hub coupled to a first tubing, a second fluid system with a second tubing connector having a second hub coupled to a second tubing, wherein the first and second fluid systems are configured to removably couple together. The hydrocarbon system also includes a window disposed axially between the first and second hubs. The window is configured to enable at least one of: installation or removal of a pressure cap assembly relative to the first hub while the first and second fluid systems are coupled together; or coupling together of the first and second fluid systems while the pressure cap assembly is installed on the first hub.

In accordance with certain embodiments, a method includes configuring a first fluid system, a second fluid system, and a pressure cap assembly of a hydrocarbon system. The first fluid system includes a first tubing connector having a first hub coupled to a first tubing, the second fluid system includes a second tubing connector having a second hub coupled to a second tubing, and the first and second fluid systems are configured to removably couple together. A window is disposed axially between the first and second hubs. The window is configured to enable at least one of: installation or removal of the pressure cap assembly relative to the first hub while the first and second fluid systems are coupled together; or coupling together of the first and second fluid systems while the pressure cap assembly is installed on the first hub.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
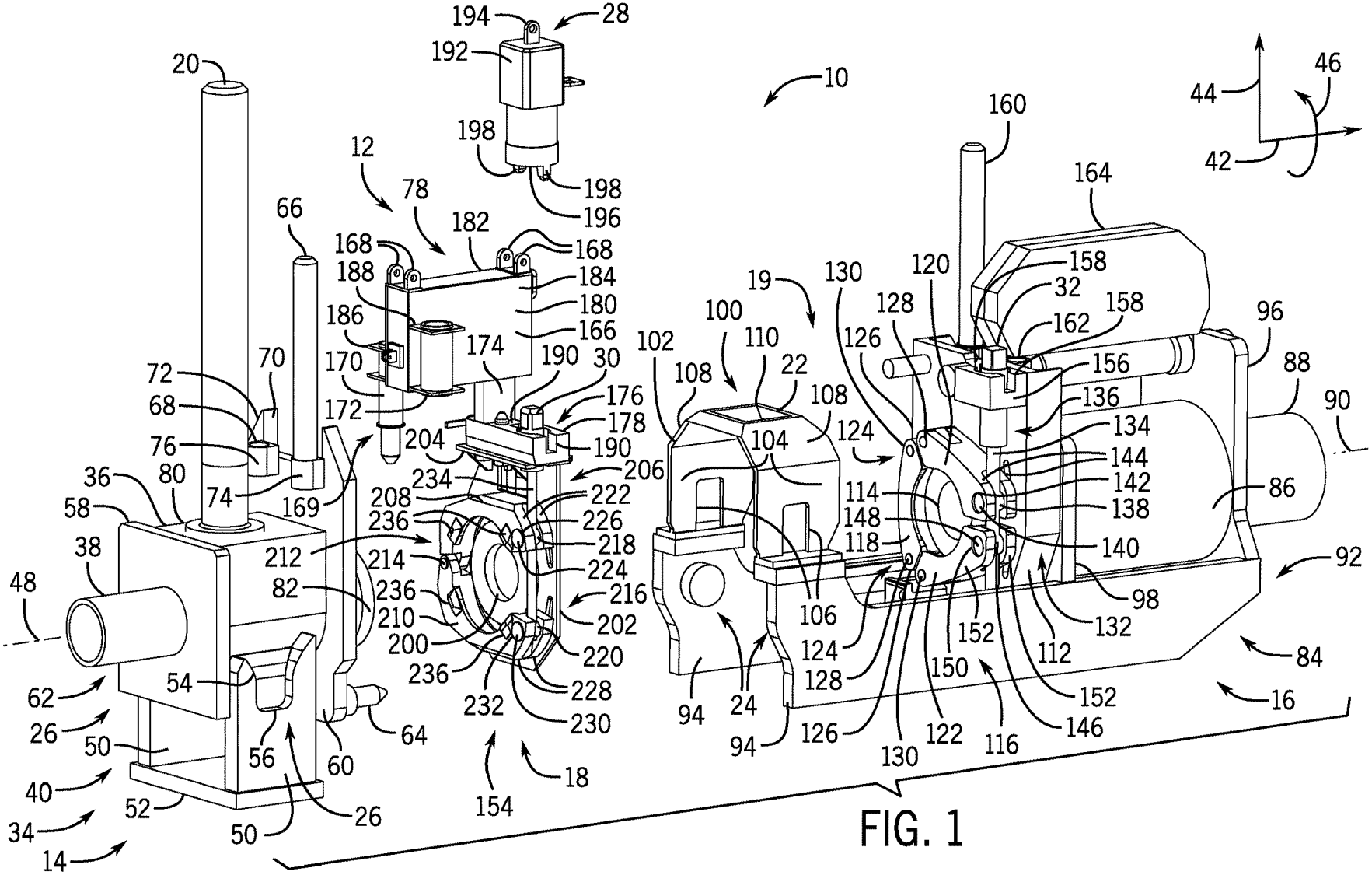
FIG. 1 is an exploded perspective view of an embodiment of a hydrocarbon system having a running tool configured to be used to install and retrieve a pressure cap assembly in various configurations of a first (e.g., inboard) fluid system and a second (e.g., outboard) fluid system.

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

As discussed in detail below, the disclosed embodiments provide a running tool and a torque tool separate from a pressure cap assembly, thereby reducing the space consumption of the pressure cap assembly and enabling use of the running tool and torque tool for multiple applications (e.g., different pressure cap assemblies or other equipment). The running tool includes alignment guides and an axial drive, while the torque tool includes alignment guides and a torque drive. The alignment guides (e.g., guide posts, guide bores, guide slots, etc.) are configured to improve the connections between the tools and equipment, thereby reducing complexity of operations by a remotely operated vehicle (ROV), ensuring proper orientations and connections, and reducing time for performing the installation or removal of the pressure cap assembly. The alignment guides of the running tool are used for alignment with the pressure cap assembly, the torque tool, and a fluid system (e.g., inboard or outboard tubing connector). The alignment guides of the torque tool are used for alignment with the running tool and the pressure cap assembly. The pressure cap assembly has a smaller footprint or space consumption, because the axial drive, the torque drive, and the alignment guides are disposed on the separate tools (e.g., the running tool and the torque tool). Additionally, the pressure cap assembly has a smaller footprint or space consumption, because the running tool and the torque tool are configured to engage the pressure cap assembly in a vertical stack (e.g., vertically above the pressure cap assembly) to minimize the horizontal footprint or space consumption of the pressure cap assembly. Thus, the pressure cap assembly can be installed and removed by the tools (e.g., the running tool and the torque tool) in smaller spaces, such as a window between hubs (e.g., inboard and outboard hubs) of different fluid systems (e.g., inboard and outboard fluid systems). For example, the pressure cap assembly can be installed on and removed from a first fluid connector (e.g., inboard connector) by the tools while a second fluid connector (e.g., outboard connector) is disposed in a wet park position. For example, in the wet park position, the second fluid connector, which includes tubing (e.g., a horizontal jumper), is generally moved away (e.g., axially stroked apart) from the first fluid connector, such that a first hub (e.g., inboard hub) of the first fluid connector is axially spaced from a second hub (e.g., outboard hub) of the second fluid connector. The tools (e.g., the running tool and the torque tool) are independent and removable from the pressure cap assembly, such that the pressure cap assembly can remain coupled to the fluid system while the tools can be retrieved and used elsewhere (e.g., multi-purpose tools). The tools (e.g., the running tool and the torque tool) and the pressure cap assembly are discussed in detail below with reference to FIGS. 1-10, which gradually step through a process of installing the pressure cap assembly.

FIG. 1 is an exploded perspective view of an embodiment of a hydrocarbon system 10 having a running tool 12 configured to be used in various configurations of a fluid system 14 (e.g., an inboard fluid system or inboard connection system) and a fluid system 16 (e.g., an outboard fluid system or outboard connection system). The hydrocarbon system 10 will be discussed in detail before discussing details of the running tool 12. The hydrocarbon system 10 may include an oil and/or gas production system, transportation system, processing system, or any combination thereof. The fluid systems 14 and 16 may correspond to different tubing sections (e.g., piping) of a tubing system, which may include connections to one or more hydrocarbon wells, Christmas trees, valves, fluid processing equipment, jumpers, or any combination thereof. As illustrated, the running tool 12 is removably coupled to a pressure cap assembly 18, which may be removably coupled to the fluid system 14. Additionally, the running tool 12 may be separated from the pressure cap assembly 18 and used to install or remove a pressure cap assembly, which may be the same or different from the pressure cap assembly 18, with the fluid system 16 or other equipment. For example, the running tool 12 may be configured to remove, install, and/or replace seals (e.g., annular seals), packers, wear components, valves, or other equipment. By further example, the running tool 12 may be configured to perform cleaning processes, inspection processes, service/maintenance processes, or any combination thereof. The cleaning processes may include hub cleaning of a hub coupled to a tubing and/or valve cleaning of a valve element.

In the illustrated embodiment, the running tool 12 coupled to the pressure cap assembly 18 is sized and configured to fit within a window 19 at least partially between the fluid systems 14 and 16 and/or within the fluid system 16. For example, the fluid systems 14 and 16 are configured to align and removably couple together via an alignment post 20 of the fluid system 14 that aligns and extends through an alignment opening 22 of the fluid system 16 and guide pins 24 of the fluid system 16 that align and extends into guide slots 26 of the fluid system 14. Accordingly, the running tool 12 may be configured to removably connect the pressure cap assembly 18 with the fluid system 14 alone, with the fluid system 14 while coupled to the fluid system 16 (e.g., via the window 19), with the fluid system 16 alone, and/or with the fluid system 16 while coupled to the fluid system 14 (e.g., via the window 19). However, in the illustrated embodiment, the running tool 12 may be used for installing or retrieving the pressure cap assembly 18 relative to the fluid system 14. The hydrocarbon system 10 also includes a torque tool 28 configured to engage a torque tool interface 30 of the pressure cap assembly 18 and/or a torque tool interface 32 of the fluid system 16. As illustrated, the torque tool 28 is separate from the running tool 12, and the running tool 12 is separate from the pressure cap assembly 18 and the fluid systems 14 and 16. Accordingly, the running tool 12 may be used in a variety of applications to install and retrieve pressure cap assemblies 18 and/or other equipment in the hydrocarbon system 10.

The fluid system 14 includes a tubing connector 34 (e.g., inboard tubing connector) having a body 36, a tubing 38 (e.g., flexible or rigid metal pipe) extending through the body 36, and a support base 40 coupled to the body 36. For the following discussion, reference may be made to an axial direction or axis 42, a radial direction or axis 44 generally perpendicular to the axial direction or axis 42, and a circumferential direction or axis 46 extending circumferentially around the axial direction or axis 42. The tubing 38 extends axially along the axial direction or axis 42, as indicated by a central axis 48. The support base 40 extends radially away from the body 36, wherein the support base 40 includes opposite side plates 50 coupled to opposite sides of the body 36 and coupled to a base plate 52. The side plates 50 each include one of the guide slots 26 discussed above. As illustrated, each of the guide slots 26 includes a tapered opening 54 (e.g., diverging opening) extending into a rectangular slot 56. The tapered opening 54 is configured to facilitate alignment and guiding of the guide pins 24 into the guide slots 26. The tubing connector 34 also includes opposite plates 58 and 60 disposed on axially opposite sides of the body 36, thereby defining a housing 62 of the tubing connector 34. The illustrated plates 58 and 60 are generally rectangular plates, wherein the tubing 38 extends axially through the plates 58 and 60.

The fluid system 14 includes a plurality of alignment guides or features, which may be used for alignment with the fluid system 16, the running tool 12, the pressure cap assembly 18, and/or other equipment. For example, the plate 60 includes one or more guide pins 64 extending axially away from the plate 60 along the axial direction 42. The guide pins 64 may facilitate a guided connection with the fluid system 16 and/or other equipment. The plate 60 also includes an alignment post 66, an alignment bore 68, and an alignment slot 70 disposed in an upper tapered portion 72, wherein the alignment post 66, the alignment bore 68, and the alignment slot 70 are oriented in the radial direction 44. For example, axes of the alignment post 66, the alignment bore 68, and the alignment slot 70 may be parallel with the radial direction or axis 44. The alignment post 66 may be coupled to the plate 60 via an alignment support bracket 74, while the alignment bore 68 may be disposed through an alignment support bracket 76. In certain embodiments, the alignment slot 70 may be a rectangular slot 70 sized to fit around a body 78 of the running tool 12. As further illustrated, the alignment post 20 is coupled to a top surface 80 of the body 36, wherein the alignment post 20 extends in the radial direction 44 away from the central axis 48 of the tubing 38. In the illustrated embodiment, the alignment post 20, the alignment post 66, the alignment bore 68, the alignment slot 70, and the guide slots 26 all face in a radially upward direction, thereby facilitating connections with the running tool 12 and the fluid system 16 as discussed in further detail below.

The tubing connector 34 also includes a hub 82 coupled to the tubing 38 at the plate 60. The hub 82 is configured to enable a fluid connection with the pressure cap assembly 18 via the running tool 12 or a fluid connection with the fluid system 16. The hub 82 includes an annular body extending radially outward from the tubing 38 relative to the central axis 48. For example, the annular body of the hub 82 may include one or more annular flanges, an annular groove, or other features configured to engage with the pressure cap assembly 18 or a mating hub (e.g., hub 114) of the fluid system 16.

The fluid system 16 includes a tubing connector 84 (e.g., outboard tubing connector) having a body 86, a tubing 88 extending in the axial direction 42 through the body 86 along a central axis 90, and a support base 92 coupled to the body 86. The support base 92 includes opposite side plates 94 (e.g., bottom support rails) coupled to the body 86 at plates 96 and 98 (e.g., intermediate supports). The side plates 94 extend in the axial direction 42 and are generally parallel to one another. The plates 96 and 98 are disposed on axially opposite sides of the body 86 and are generally parallel to one another and extend in the radial direction 44. The side plates 94 further include the guide pins 24 extending inwardly toward one another for engagement with the guide slots 26 on the side plates 50 of the fluid system 14. Above the guide pins 24, the side plates 94 are further coupled together via a cover 100, which has a U-shaped body 102. The U-shaped body 102 of the cover 100 includes opposite side plates 104 having respective slots 106, opposite tapered plates 108 coupled to the respective side plates 104, and a central portion 110 coupled to the tapered plates 108 and including the alignment opening 22. In the illustrated embodiment, the alignment opening 22 is a square or rectangular opening disposed generally at the center between the opposite side plates 104 and the opposite side plates 94. However, the alignment opening 22 may include a circular opening or another suitable opening shape configured to mate with the alignment post 20 of the fluid system 14.

The fluid system 16 further includes a drive plate 112 coupled to the tubing 88 adjacent the plate 98. Adjacent the drive plate 112, the tubing connector 84 also may include a hub 114 coupled to the tubing 88 to facilitate connections with other tubing or hubs, such as the hub 82 of the fluid system 14. The hub 114 includes an annular body extending radially outward from the tubing 88 relative to the central axis 90. For example, the annular body of the hub 114 may include one or more annular flanges, an annular groove, or other features configured to engage with the hub 82 of the fluid system 14, a pressure cap assembly (e.g., 18), or other equipment. The tubing connector 84 also includes a clamp assembly 116 disposed about the hub 114 to facilitate a mechanical connection to secure the hub 114 with the hub 82, a pressure cap assembly, or another suitable piece of equipment.

In the illustrated embodiment, the clamp assembly 116 includes a plurality of clamp segments, such as clamp segments 118, 120, and 122. The adjacent clamp segments 118 and 120 are rotatably coupled together via a pivot joint 124 having a linkage 126 rotatably coupled to the clamp segments 118 and 120 via respective pins 128 and 130. Similarly, the clamp segments 118 and 122 are rotatably coupled together via a pivot joint 124 having a linkage 126 rotatably coupled to the clamp segments 118 and 122 via respective pins 128 and 130. In other embodiments, the pivot joints 124 may include a single pin connecting the respecting clamp segments 118, 120, and 122, or another suitable pivot joint. Between the clamp segments 120 and 122, the clamp assembly 116 includes an expandable connector 132 coupled to a threaded rod 134 of a torque tool assembly 136.

As part of the expandable connector 132, the clamp segment 120 includes a threaded connector 138 having trunnions 140 disposed in bores 142 in opposite plates 144 (e.g., spaced apart parallel plates) of the clamp segment 120. Similarly, the clamp segment 122 includes a threaded connector 146 having trunnions 148 disposed in bores 150 in opposite plates 152 (e.g., spaced apart parallel plates) of the clamp segment 122. The threaded rod 134 extends through each of the threaded connectors 138 and 146, which may include oppositely oriented threads (e.g., left-handed threads and right-handed threads, or vice versa) to facilitate expansion and contraction of the clamp segments 120 and 122 via rotation of the threaded rod 134 relative to the threaded connectors 138 and 146. The expansion and contraction of the clamp segments 120 and 122 may facilitate a mechanical connection between the hub 114 and the hub 82 when fluidly and mechanically connecting the fluid systems 14 and 16. The operation of the clamp assembly 116 is similar to a clamp assembly 154 of the pressure cap assembly 18 as discussed below. The threaded rod 134 extends to a torque tool bracket 156 of the torque tool assembly 136, wherein the torque tool bracket 156 includes the torque tool interface 32, alignment slots 158, and a connection with the drive plate 112. The torque tool assembly 136 is configured to engage with the torque tool 28 to rotate the threaded rod 134, which in turn operates the clamp assembly 116 via movement of the threaded connectors 138 and 148 of the clamp segments 120 and 122 to open and close the clamp assembly 116 around the hub 114.

The tubing connector 84 also may include various alignment guides to facilitate alignment with one or more tools, such as the running tool 12 and/or a tool 164. For example, the drive plate 112 may be coupled to an alignment post 160 and an alignment bore 162, which are generally aligned with the radial direction 44. The alignment post 160 and the alignment bore 162 are configured to align the running tool 12 (or another tool) with the fluid system 16 when using the running tool 12 (or another tool) to operate aspects of the fluid system 16.

The fluid system 16 also includes the tool 164 extending between the plate 96 and the drive plate 112, wherein the tool 164 may be configured to stroke or axially move the drive plate 112, the clamp assembly 116, the hub 114, and/or the tubing 88 in the axial direction 42 along the central axis 90 to facilitate a fluid and mechanical connection between the hub 114 of the fluid system 16 and the hub 82 of the fluid system 14. In certain embodiments, the tool 164 may include an electric drive, a hydraulic drive, or another suitable drive to provide a linear force along the central axis 90. Once the tool 164 moves the hub 114 into alignment with the hub 82, then the torque tool 28 may couple with the torque tool interface 32 to operate the clamp assembly 116, such that the clamp assembly 116 radially compresses about the hubs 82 and 114 to secure them together.

As discussed in further detail below, the fluid systems 14 and 16 are configured to removably align with one another by lowering the fluid system 16 onto the fluid system 14, such that the alignment post 20 extends through the alignment opening 22 and the guide pins 24 extend into the guide slots 26. Once the fluid system 16 is lowered onto the fluid system 14 with the guide pins 24 disposed in the guide slots 26, the fluid systems 14 and 16 may be further coupled together to hold their respective positions. Additionally, as discussed in further detail below, when the fluid systems 14 and 16 are aligned with one another, the window 19 enables the running tool 12 and the pressure cap assembly 18 to be inserted and removed for installation and/or removal of the pressure cap assembly 18 relative to the hub 82. The tool 164 also may remain in place between the plates 96 and 98 of the fluid system 16 while the running tool 12 is used to install or remove the pressure cap assembly 18 via the window 19.

The running tool 12 is generally separate from the pressure cap assembly 18, but the running tool 12 is configured to removably couple to both the pressure cap assembly 18 and other equipment to facilitate multiple uses of the running tool 12. In the illustrated embodiment, the running tool 12 includes the body 78 having a carrier 166, a plurality of tool line connectors 168, a plurality of alignment guides 169 (e.g., an alignment post 170 and/or an alignment bore 172), an arm 174, and a tool engagement bracket 176 having a bowtie body 178. The carrier 166 may have a generally rectangular shaped housing 180, which may be configured to fit at least partially within the alignment slot 70 of the fluid system 14 when aligning the running tool 12 with the fluid system 14. The tool line connectors 168 may include a plurality of hooks, loops, receptacles, brackets, or other removable couplings suitable to connect with a tool line used for raising and lowering and generally operating the running tool 12. The tool line may include a rigid or flexible line (e.g., rod, tube, cable, etc.) coupled to the tool line connectors 168. In certain embodiments, the tool line connectors 168 and/or other connectors (e.g., ROV connectors) may be removably coupled to a remotely operated vehicle (ROV) for operation of the running tool 12.

The alignment guides 169 (e.g., alignment post 170 and/or alignment bore 172) are configured to facilitate alignment when coupling the running tool 12 with the fluid system 14, the fluid system 16, or other equipment. The alignment post 170 is coupled to a sidewall 182 of the housing 180, while the alignment bore 172 is coupled to a sidewall 184 of the housing 180. The alignment post 170 may be mounted via one or more brackets 186 coupled to the sidewall 182, and the alignment bore 172 may be coupled to the sidewall 184 via one or more brackets 188. For example, the brackets 186 and 188 may include parallel plates, cylindrical tubes, or a combination thereof. Axes of the alignment post 170 and the alignment bore 172 may be offset and parallel to one another for interfacing with the respective alignment bore 68 and alignment post 66 of the tubing connector 34 (e.g., post 170 extends into bore 68, post 66 extends into bore 172) or for interfacing with the alignment bore 162 and the alignment post 160 of the tubing connector 84 (e.g., post 170 extends into bore 162, post 160 extends into bore 172). The axes of the alignment post 170 and the alignment bore 172 may extend generally in the radial direction 44 when used with the fluid system 14 or the fluid system 16.

The arm 174 of the running tool 12 protrudes below the housing 180 in the radial direction 44, which is also generally parallel with axes of the alignment post 170 and the alignment bore 172. The tool engagement bracket 176, and particularly the bowtie body 178, extends laterally or perpendicular from the arm 174 for engagement with a top portion of the pressure cap assembly 18. As discussed in further detail below, the tool engagement bracket 176 is configured to removably couple with the top portion of the pressure cap assembly 18. As illustrated, the torque tool interface 30 of the pressure cap assembly 18 extends through the bowtie body 178 of the tool engagement bracket 176, while the bowtie body 178 includes alignment slots 190 disposed on opposite sides of the torque tool interface 30. The alignment slots 190 are configured to provide alignment when removably connecting the torque tool 28 with the torque tool interface 30.

The torque tool 28 includes a body 192 having a tool line connector 194 and a torque tool interface 196 disposed between alignment pins 198. Internally, the torque tool 28 may include an electric motor or drive, a hydraulic motor or drive, or another suitable torque inducing drive. The alignment pins 198 are configured to insert into the alignment slots 190 of the tool engagement bracket 176 of the running tool 12, when removably coupling with the pressure cap assembly 18 for actuation of the clamp assembly 154 to connect or disconnect the pressure cap assembly 18 relative to the hub 82. Additionally, the alignment pins 198 may be configured to insert into the alignment slots 158 of the torque tool bracket 156 on the tubing connector 84 when used to operate the clamp assembly 116. The torque tool interface 196 is configured to rotatably interlock with and rotate the torque tool interface 30 of the pressure cap assembly 18 or the torque tool interface 32 of the torque tool assembly 136. As discussed below, the torque tool interface 196, the torque tool interface 30, and the torque tool interface 32 may include one or more flats, keys, or other anti-rotation features to facilitate transfer of torque between the torque tool 28 and the torque tool interfaces 30 and 32.

The pressure cap assembly 18 includes a pressure cap 200, a support plate 202 coupled to the pressure cap 200, the clamp assembly 154 movably coupled to the support plate 202 and disposed circumferentially about the pressure cap 200, a tool interface plate 204 coupled to the support plate 202, and a torque tool assembly 206 coupled to the clamp assembly 154 and the tool interface plate 204. The pressure cap 200 is an annular cap configured to engage with the hub 82 of the tubing connector 34, while the clamp assembly 154 is configured to extend circumferentially about both the pressure cap 200 and the hub 82 to mechanically and fluidly connect the pressure cap 200 with the hub 82. The pressure cap 200 and the clamp assembly 154 are configured to align (e.g., coaxial) with the central axis 48 of the tubing 38 when connecting with the hub 82. The plate 202 generally extends along the radial direction or axis 44, and the tool interface plate 204 may be generally perpendicular to the support plate 202. The clamp assembly 154 may be coupled to the support plate 202 at one or more pivot joints (e.g., pins) and/or to the torque tool assembly 206.

The clamp assembly 154 includes a plurality of clamp segments, such as clamp segments 208 and 210 rotatably coupled together at an intermediate pivot joint 212. The pivot joint 212 may include one or more pins, such as the two pin arrangement of the clamp assembly 116 or a single pin arrangement having a pin 214 extending between the clamp segments 208 and 210. The pin 214 of the pivot joint 212 may be coupled to the support plate 202, such that the clamp segments 208 and 210 can pivot about the pin 214 while being retained to the support plate 202.

The clamp assembly 154 also includes an expandable connector 216 similar to the expandable connector 132 of the clamp assembly 116. As illustrated, the expandable connector 216 may include a threaded connector 218 coupled to the clamp segment 208 and a threaded connector 220 coupled to the clamp segment 210. The threaded connector 218 may be disposed between opposite plates 222 (e.g., spaced apart parallel plates) of the clamp segment 208, wherein the threaded connector 218 has trunnions 224 disposed in respective bores 226 in the opposite plates 222. The threaded connector 220 may have the same configuration as the threaded connector 218, wherein the threaded connector 220 is disposed between opposite plates 228 (e.g., spaced apart parallel plates) and has trunnions 230 disposed in respective bores 232 in the opposite plates 228. Accordingly, each of the threaded connectors 218 and 220 is configured to rotate between the respective plates 222 and 228 via the trunnions 224 and 230. Additionally, the threaded connectors 218 and 220 can move toward and away from one another via pivoting at the pin 214 of the pivot joint 212. The expandable connector 216 further includes threaded connections with the torque tool assembly 206, which includes a threaded rod 234 coupled to the threaded connectors 218 and 220 and coupled to the torque tool interface 30. The threaded rod 234 is threaded into the threaded connectors 218 and 220, such as with oppositely oriented threads (e.g., left-handed threads and right-handed threads, or vice versa) to facilitate expansion and contraction of the clamp segments 208 and 210 via rotation of the threaded rod 234. The threaded rod 234 also extends through the tool interface plate 204 and couples with the torque tool interface 30.

The pressure cap assembly 18 also may include one or more bumpers 236 disposed on the clamp segments 208 and 210, wherein the bumpers 236 face toward the plate 60 and abut the plate 60 when the running tool 12 is used to install the pressure cap assembly 18 at the hub 82 of the tubing connector 34. In certain embodiments, the bumpers 236 may include elastomeric bumpers, springs, or other compressible materials or mechanisms. The bumpers 236 also may serve as stops to facilitate alignment between the hub 82, the clamp assembly 164, and the pressure cap 200.

Figure 2:
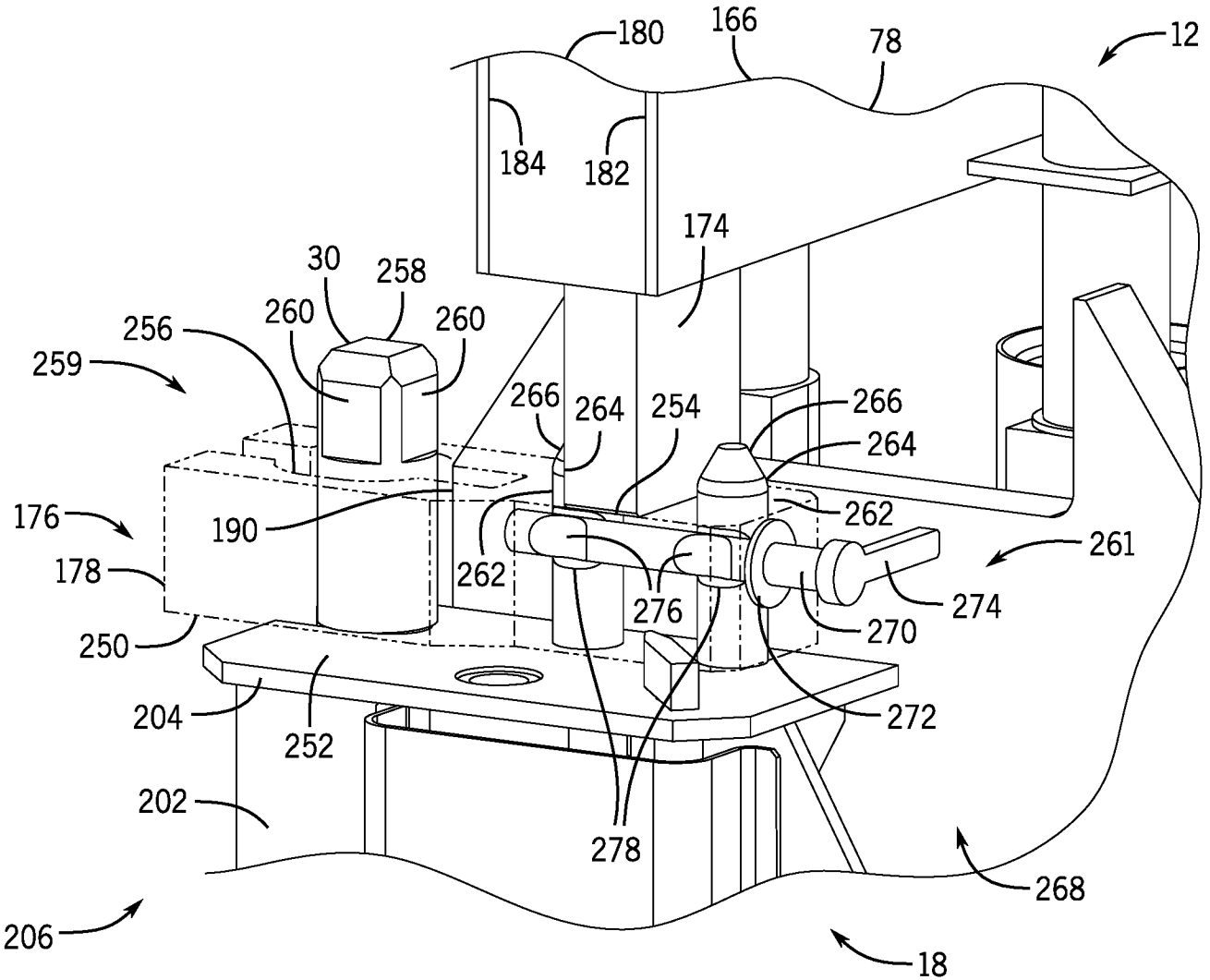
FIG. 2 is a partial perspective view of an embodiment of the hydrocarbon system of FIG. 1, illustrating the running tool removably coupled to the pressure cap assembly.

FIG. 2 is a partial perspective view of an embodiment of the hydrocarbon system 10 of FIG. 1, illustrating the running tool 12 removably coupled to the pressure cap assembly 18. As illustrated, the tool engagement bracket 176 of the running tool 12 is removably coupled to the pressure cap assembly 18 at the tool interface plate 204, such that an interface surface 250 of the bowtie body 178 is disposed on an interface surface 252 of the tool interface plate 204. The tool engagement bracket 176 is coupled to the arm 174 via a fixed or removable joint, wherein one or more spacer plates 254 may be disposed between the arm 174 and the bowtie body 178 to adjust the spacing and thus positioning of the pressure cap 200 relative to the hub 82. The arm 174 may be coupled to the bowtie body 178 with a plurality of fasteners, such as threaded bolts and nuts. The tool engagement bracket 176 also includes a plurality of tool engagement features 259 for engagement with the torque tool 28 and alignment and locking features 261 for removably connecting the running tool 12 with the pressure cap assembly 18.

Regarding the tool engagement features 259, the bowtie body 178 includes an opening 256 disposed between the opposite alignment slots 190, which are configured to facilitate engagement with the torque tool 28. For example, the opening 256 is sized larger than the torque tool interface 30 and sufficiently large to receive a portion of the torque tool interface 196 of the torque tool 28. The illustrated alignment slots 190 are disposed on diametrically opposite sides of the opening 256. However, embodiments of the tool engagement bracket 176 may have other orientations of the alignment slots 190 to accommodate engagement with the alignment pins 198 of the torque tool 28. The torque tool interface 30 includes a post 258 extending through the tool interface plate 204 to a height at least partially above the tool engagement bracket 176. Additionally, the post 258 includes a plurality of flats 260 disposed about the perimeter of the post 258. For example, the post 258 may include 2, 3, 4, 5, or more flats 260 (e.g., defining a square shape) configured to engage with corresponding flats (e.g., square shape) on the torque tool interface 196 of the torque tool 28. The torque tool interface 196 of the torque tool 28 may be a female interface (e.g., square shaped receptacle), while the post 258 with flats 260 may correspond to a male interface (e.g., square shaped post). The post 258 is configured to rotate within the opening 256 and within the tool interface plate 204, thereby rotating the threaded rod 234 to operate the clamp assembly 154 as discussed in detail above.

Regarding the alignment and locking features 261, the bowtie body 178 of the tool engagement bracket 176 also a plurality of alignment bores 262 extending through the bowtie body 178 to the tool interface plate 204, which has alignment pins 264 protruding upwardly from the tool interface plate 204 through the alignment bores 262. The alignment pins 264 also include tapered tips 266 configured to help guide the alignment pins 264 into the alignment bores 262. For example, the alignment pins 264 may be cylindrical pins having a frustoconical shape for the tapered tips 266. Similarly, the alignment bores 262 may be cylindrical bores extending completely through the bowtie body 178. Accordingly, when the running tool 12 is being lowered onto the pressure cap assembly 18, the tapered tips 266 initially enter the alignment bores 262 and then guide the alignment pins 264 completely through the alignment bores 262 in the bowtie body 178. Additionally, the post 258 of the torque tool interface 30 gradually moves through the opening 256 in the bowtie body 178 when lowering the running tool 12 onto the pressure cap assembly 18. Once the running tool 12 is lowered onto the pressure cap assembly 18 as illustrated in FIG. 2, a tool lock assembly 268 may be engaged to secure the tool engagement bracket 176 to the alignment pins 264 of the tool interface plate 204.

As illustrated, the tool lock assembly 268 includes a locking rod 270 extending in a bore 272 within the bowtie body 178, and a lever 274 (or mechanical actuator) coupled to an end portion of a locking rod 270. The locking rod 270 includes lock release slots 276 aligned with the alignment pins 264 configured to enable insertion and removal of the alignment pins 264 in the alignment bores 262. In other words, when installing or removing the running tool 12 from the pressure cap assembly 18, the lever 274 may be rotated to position the lock release slots 276 directly facing the alignment pins 264, such that the locking rod 270 is not secured to the alignment pins 264 and the alignment pins 264 can freely move through the alignment bores 262. However, the lever 274 may be used to rotate the locking rod 270 to position the lock release slots 276 away from the alignment pins 264, while also positioning the locking rod 270 within respective locking slots 278 in sides of the alignment pins 264. When the locking slots 278 receive the locking rod 270, the locking rod 270 blocks upward and downward movement of the bowtie body 178 relative to the alignment pins 264. In this manner, the tool lock assembly 268 is configured to enable removable coupling between the running tool 12 and the pressure cap assembly 18.

Figure 3:
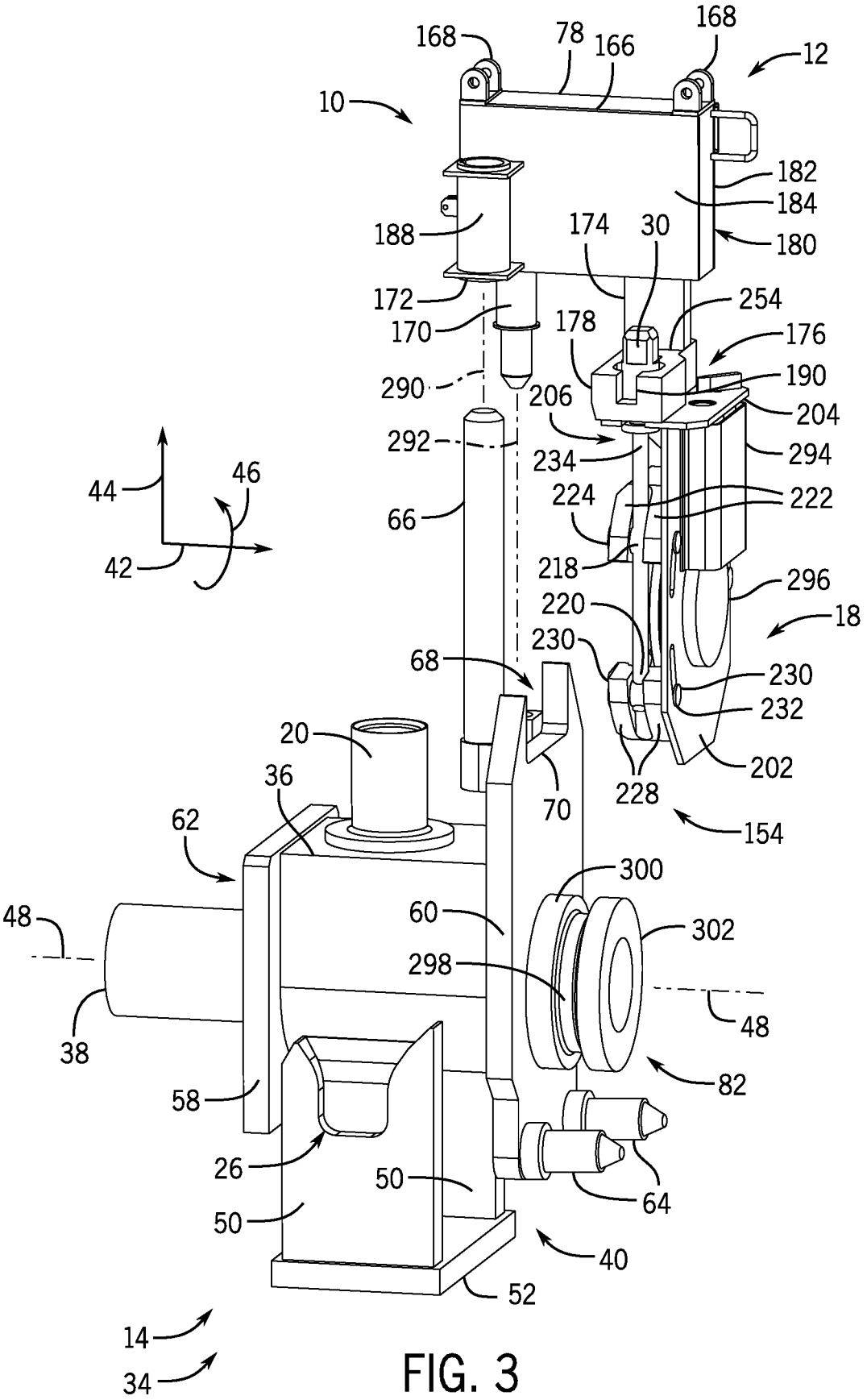
FIG. 3 is an exploded perspective view of an embodiment of the hydrocarbon system of FIGS. 1 and 2, illustrating the running tool removably coupled to the pressure cap assembly while lowing the pressure cap assembly toward a tubing connector (e.g., inboard tubing connector) of the first fluid system.

FIG. 3 is an exploded perspective view of an embodiment of the hydrocarbon system 10 of FIGS. 1 and 2, illustrating the running tool 12 removably coupled to the pressure cap assembly 18 while lowing the pressure cap assembly 18 toward the tubing connector 34 of the fluid system 14. As illustrated, the alignment bore 172 of the running tool 12 is aligned coaxially with the alignment post 66 of the tubing connector 34 as illustrated by axis 290, while the alignment post 170 of the running tool 12 is aligned coaxially with the alignment bore 68 of the tubing connector 34 of the fluid system 14 as indicated by axis 292. In certain embodiments, the body 78 of the running tool 12 may be aligned with the alignment slot 70 of the tubing connector 34 of the fluid system 14, particularly such that the opposite side walls 182 and 184 are disposed toward the opposite sides of the alignment slot 70. The running tool 12 gradually lowers the pressure cap assembly 18 into alignment with the hub 82 of the tubing connector 34, while being guided in the vertical direction along the axes 290 and 292 as the alignment post 66 extends axially into the alignment bore 172 and the alignment post 170 extends axially into the alignment bore 68.

The pressure cap assembly 18 includes the components discussed in detail above, and further includes a cover 294 coupled to the plate 202 and a blind outward hub portion 296 coupled to the plate 202. The cover 292 may be configured to cover valves, fluid conduits, and other equipment for operation of the pressure cap assembly 18. The blind outward hub portion 296 may be coupled to and/or part of the pressure cap 200.

The hub 82 of the tubing connector 34 includes an annular groove 298 disposed axially between opposite annular flanges 300 and 302. As discussed in further detail below, guided by the alignment post 66 in the alignment bore 172 and the alignment post 170 in the alignment bore 68, the running tool 12 lowers the pressure cap assembly 18 until the pressure cap 200 is aligned with the hub 82 along the central axis 48. The running tool 12 then axially moves (e.g., axially strokes) the pressure cap assembly 18 along the central axis 48 toward the hub 82, such that the clamp assembly 154 is properly aligned (e.g., concentric) with the annular groove 298 and the annular flanges 300 and 302 of the hub 82. The torque tool 28 then engages the torque tool interface 30 to actuate the clamp assembly 154 to compress about the hub 82 and connect the pressure cap 200 onto the hub 82. In the illustrated embodiment, a portion of the alignment post 20 is cut away for simplicity. However, the alignment post 20 has the geometry as illustrated and described above with reference to FIG. 1. All other aspects of the running tool 12, the pressure cap assembly 18, and the fluid system 14 are as described in detail above with reference to FIGS. 1 and 2.

Figure 4:
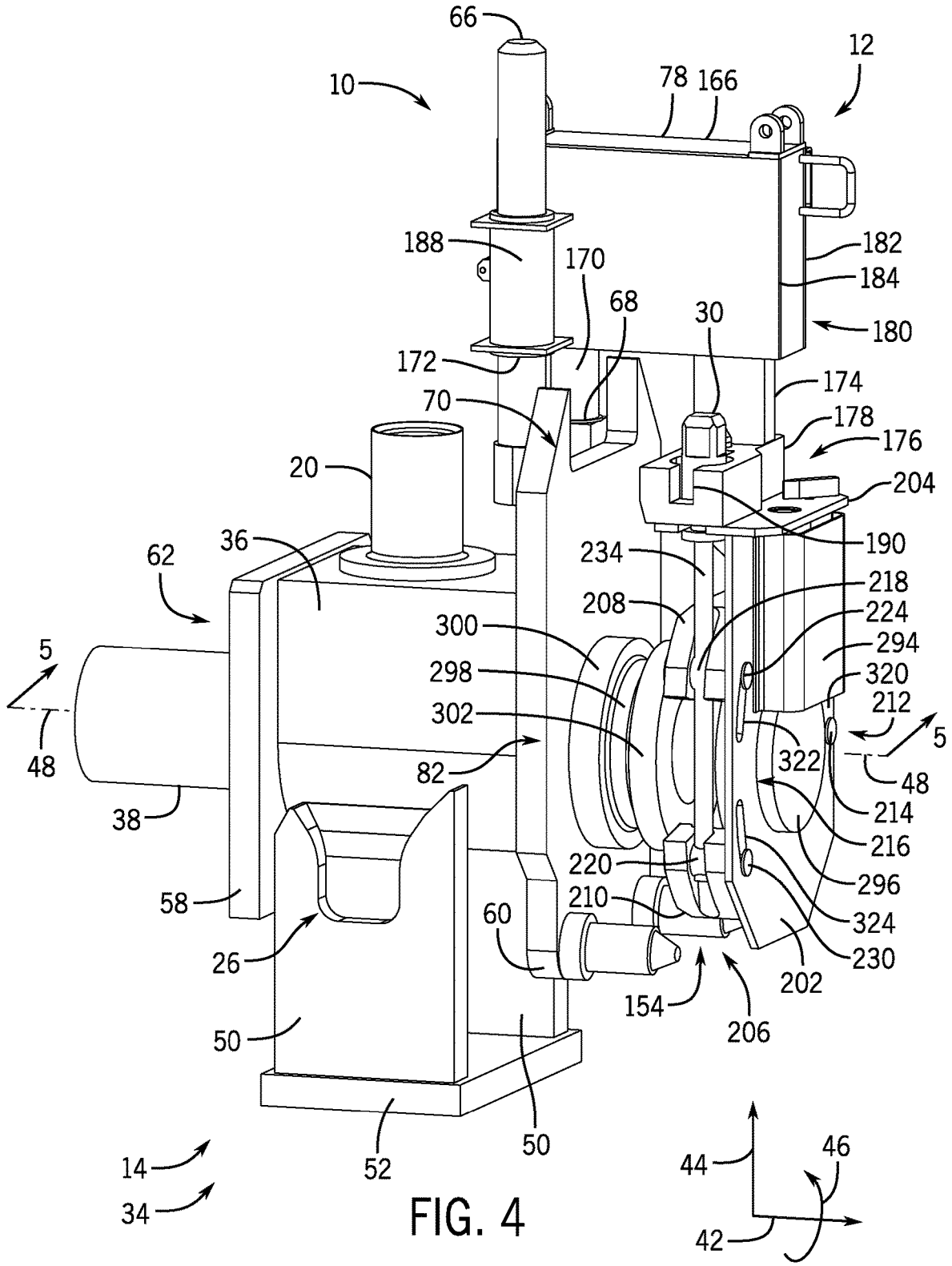
FIG. 4 is a perspective view of an embodiment of the hydrocarbon system of FIGS. 1-3, illustrating the running tool coupled to the first fluid system with the pressure cap assembly aligned with a hub prior to a connection with the hub.

FIG. 4 is a perspective view of an embodiment of the hydrocarbon system 10 of FIGS. 1-3, further illustrating the running tool 12 coupled to the fluid system 14 with the pressure cap assembly 18 aligned with the hub 82 prior to a connection with the hub 82. As discussed above, the running tool 12 is vertically lowered onto the tubing connector 34, such that the alignment post 66 of the tubing connector 34 extends into the alignment bore 172 of the running tool 12 and the alignment post 170 of the running tool 12 extends into the alignment bore 68 of the tubing connector 34. The running tool 12 is shown fully lowered and aligned with the tubing connector 34 (e.g., coaxial with the central axis 48). As illustrated in FIG. 4, the pressure cap assembly 18 is axially spaced apart from the hub 82, such as prior to a connection with the hub 82 and/or after disconnection from the hub 82. For example, if the running tool 12 is being used for installation of the pressure cap assembly 18, then the running tool 12 has not yet been actuated to move (e.g., axially stroke) the pressure cap assembly 18 in the axially direction 42 along the central axis 48 to abut the pressure cap 200 with the hub 82 and align the clamp assembly 154 about the hub 82 (e.g., concentric with the hub 82). Again, for simplicity, the alignment post 20 of the tubing connector 34 is shown partially cut away in FIG. 4. The next step in the installation of the pressure cap assembly 18 is operating the running tool 12 to move (e.g., axially stroke) the pressure cap assembly 18 along the central axis 48 as discussed in detail below with reference to FIGS. 5 and 6.

As further illustrated in FIG. 4, the clamp assembly 154 is movably coupled to the support plate 202 via the pin 214 of the pivot joint 212, the trunnion 224 of the threaded connector 218, and the trunnion 230 of the threaded connector 220. In particular, the pin 214 of the pivot joint 212 is disposed in and coupled to a circular opening 320 in the support plate 202, such that the pin 214 enables rotation of the clamp segments 208 and 210 about a fixed rotational axis of the pin 214. In contrast, the trunnion 224 is coupled to and moves along an arcuate slot 322, while the trunnion 230 is coupled to and moves along an arcuate slot 324. While the threaded rod 234 of the torque tool assembly 206 rotates to actuate the clamp assembly 154, the threaded connectors 218 and 220 of the clamp segments 208 and 210 move toward or away from one another, while the trunnions 224 and 230 move lengthwise along the respective arcuate slots 322 and 324. In the illustrated embodiment, the radius of the arcuate slots 322 and 324 follows an arcuate path of movement of the threaded connectors 218 and 220 while the clamp segments 208 and 210 rotate about the pin 214 of the pivot joint 212. The pin 214 and the trunnions 224 and 230 may include enlarged heads and/or retainers to block removal from the support plate 202. For example, the retainers may include C-clips, pins, threaded fasteners, or other couplings to secure the pin 214 and the trunnions 224 and 230 relative to the support plate 202.

Figure 5:
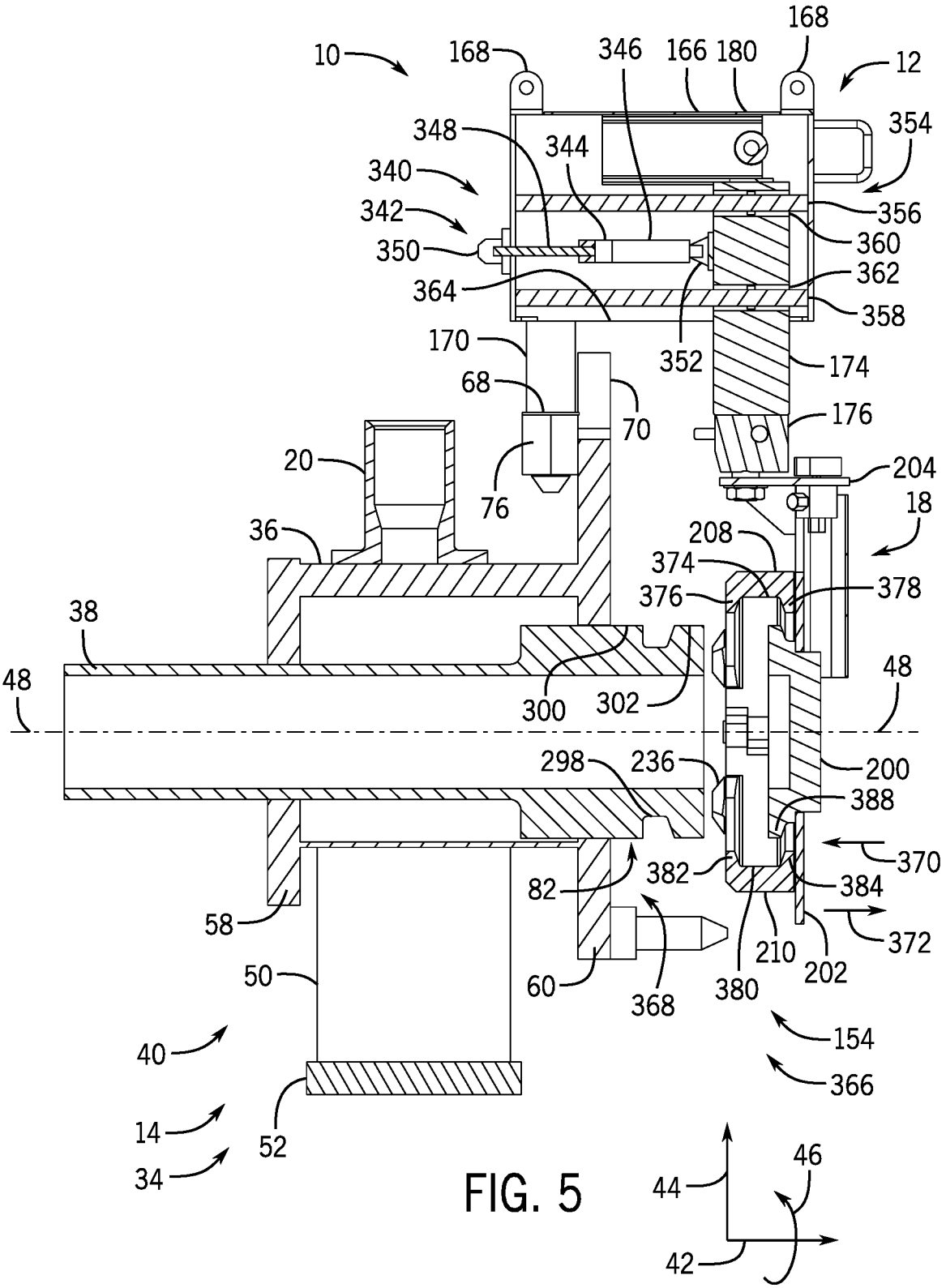
FIG. 5 is a cross-sectional view of an embodiment of the hydrocarbon system of FIGS. 1-4, taken along a plane as indicated by line or section 5-5 in FIG. 4, further illustrating details of the running tool for moving the pressure cap assembly in the axial direction for installation or removal of the pressure cap assembly.

FIG. 5 is a cross-sectional view of an embodiment of the hydrocarbon system 10 of FIGS. 1-4, taken along a plane as indicated by line or section 5-5 in FIG. 4, further illustrating details of the running tool 12 for moving (e.g., axially stroking) the pressure cap assembly 18 in the axial direction 42 along the central axis 48 for installation or removal of the pressure cap assembly 18. As illustrated, the running tool 12 has an axial drive 340 disposed within the housing 180 of the carrier 166. The axial drive 340 is configured to move the arm 174 in the axial direction 42 along the central axis 48. The axial drive 340 may include an electric drive, a hydraulic drive, a pneumatic drive, or any combination thereof. In the illustrated embodiment, the axial drive 340 includes a piston cylinder assembly 342 having a piston 344 disposed within a cylinder 346, wherein the piston 344 is coupled to a rod 348. The rod 348 is further coupled to the housing 180 at a mounting bracket 350. The piston 344 is configured to move axially along a length of the cylinder 346 in the axial direction 42. For example, one or more fluid supplies (e.g., gas supply and/or hydraulic liquid supply) may provide a pressurized fluid (e.g., gas or liquid) within the cylinder 346 against a side of the piston 344 to axially move the piston 344 relative to the cylinder 346, or to axially move the cylinder 346 relative to the piston 344. In the illustrated embodiment, the cylinder 346 is coupled to the arm 174 at a bracket 352, such that the cylinder 346 and the arm 174 move together in the axially direction 42 in response to a pressure on one of the sides of the piston 344 inside the cylinder 346.

The axial drive 340 also may include a guide assembly 354 configured to guide movement of the arm 174 in the axial direction 42 within the carrier 166. In the illustrated embodiment, the guide assembly 354 includes a plurality of axial guide bars, such as axial guide bars 356 and 358 (e.g., cylindrical rods) extending through the housing 180 of the carrier 166. The guide assembly 354 also includes a plurality of axial guide bores, such as axial guide bores 360 and 362 (e.g., cylindrical bores) disposed though the arm 174. The axial guide bar 356 extends the axial guide bore 360, while the axial guide bar 358 extends through the axial guide bore 362. As the piston cylinder assembly 342 of the axial drive 340 drives axial movement of the cylinder 346 coupled to the arm 174, the arm 174 moves along the axial direction 42 while the axial guide bars 356 and 358 disposed in the respective axial guide bores 360 and 362 guide the arm 174 to move along an axial slot 364 in a bottom portion of the housing 180. Therefore, the arm 174 can move along the axial slot 364, which also may facilitate axial guiding of the arm 174. The axial drive 340 may be configured to provide a range of movement in the axial direction 42 suitable to move the pressure cap assembly 18 between an axially offset position 366 (e.g., axial spacing between the hub 82 and the pressure cap assembly 18) as shown in FIG. 5 and an axially aligned position 368 disposed about the hub 82 (e.g., concentric arrangement of the clamp assembly 154 and the hub 82 and the pressure cap 200 axially abutting the hub 82) as discussed in further detail below with reference to FIG. 6.

In operation, the axial drive 340 of the running tool 12 may be actuated to move the arm 174 and the pressure cap assembly 18 in an axial direction 370 inwardly toward the hub 82 from the axially offset position 366 toward the axially aligned position 368 (e.g., during an installation procedure) or in an axial direction 372 outward away from the hub 82 from the axially aligned position 368 to the axially offset position 366 (e.g., during a removal procedure). As further illustrated in FIG. 5, the clamp assembly 154 has features to engage with the hub 82 and secure the pressure cap 200 to the hub 82. For example, the clamp segment 208 includes an arcuate slot 374 disposed axially between arcuate protrusions 376 and 378, wherein the arcuate slot 374 is recessed in an outward radial direction 44 relative to the central axis 48 while the arcuate protrusions 376 and 378 extend in an inward radial direction 44 toward the central axis 48. Similarly, the clamp segment 210 includes an arcuate slot 380 disposed axially between arcuate protrusions 382 and 384, wherein the arcuate slot 380 is recessed in an outward radial direction 44 relative to the central axis 48 while the arcuate protrusions 382 and 384 extend in an inward radial direction 44 toward the central axis 48. The pressure cap 200 also includes an outer annular lip 386, which is configured to abut against the annular flange 302 of the hub 82 when the pressure cap assembly 18 is moved axially from the axially offset position 366 to the axially aligned position 368 in the axial direction 370.

In operation, as discussed in detail below, the clamp assembly 154 is driven by the torque tool 28 when coupled to the torque tool interface 30 of the torque tool assembly 206, thereby moving the clamp segments 208 and 210 radially inward and outward relative to the central axis 48. As the clamp segments 208 and 210 move radially inward toward the central axis 48, the arcuate protrusions 376 and 382 of the clamp segments 208 and 210 are configured to extend radially into the annular groove 298 of the hub 82, the annular flange 302 of the hub 82 and the annular lip 386 of the pressure cap 200 extend into the arcuate slots 374 and 380 of the clamp segments 208 and 210, and the arcuate protrusions 378 and 384 extend around an opposite side of the annular lip 386. In this manner, the annular flange 302 of the hub 82 and the annular lip 386 of the pressure cap 200 are captured in the arcuate slots 374 and 380 of the clamp segments 208 and 210 between the arcuate protrusions 376 and 378 of the clamp segment 208 and between the arcuate protrusions 382 and 384 of the clamp segment 210. Although FIG. 5 illustrates the pressure cap assembly 18 disposed in the axially offset position 366, when the pressure cap assembly 18 is disposed in the axially aligned position 368 as illustrated in FIG. 6, the clamp assembly 154 may be secured about the hub 82 and the pressure cap 200 to seal the tubing 38.

Figure 6:
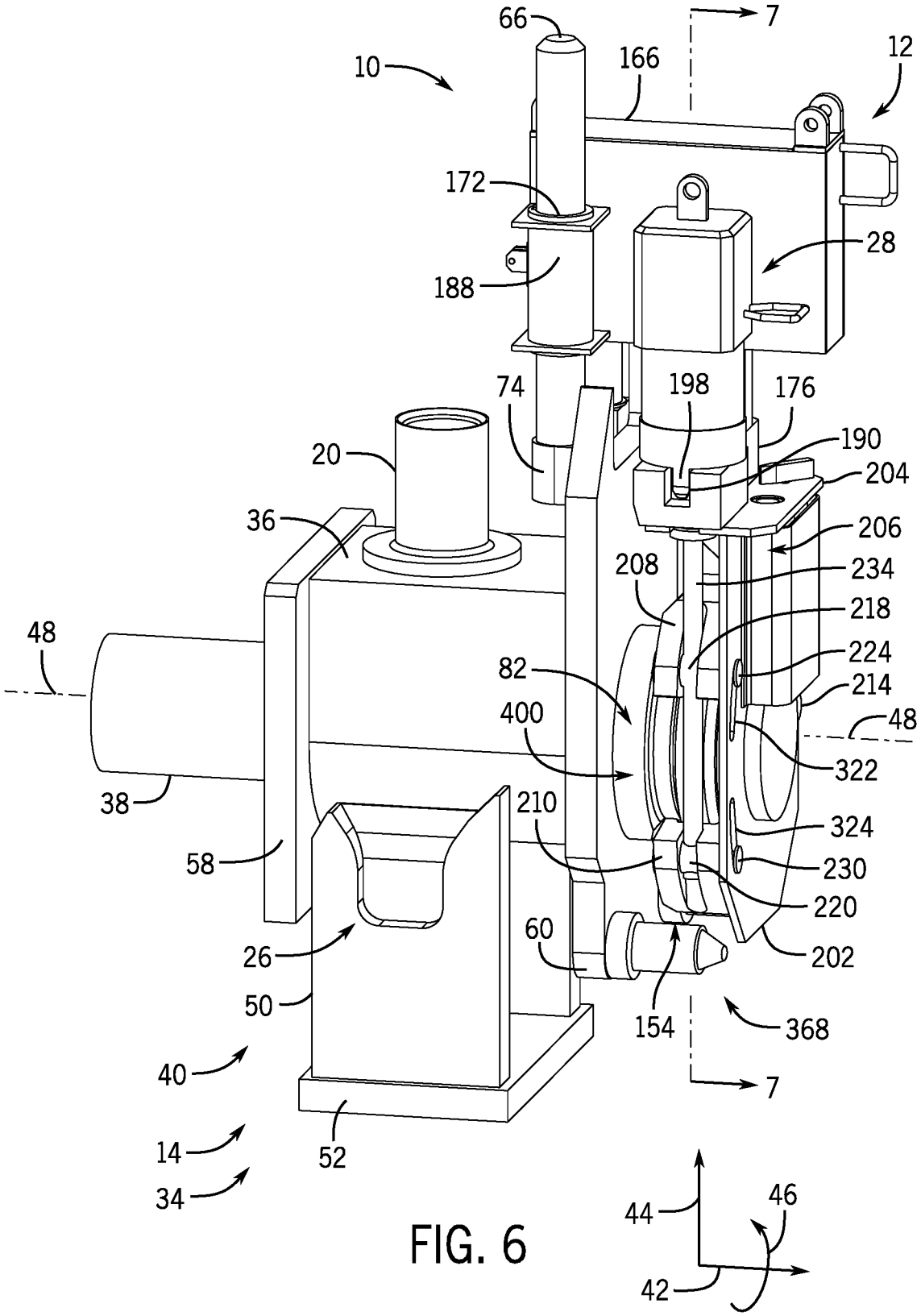
FIG. 6 is a perspective view of an embodiment of the hydrocarbon system of FIGS. 1-5, further illustrating a torque tool coupled to the running tool and a torque tool assembly of the pressure cap assembly for actuation of a clamp assembly.

FIG. 6 is a perspective view of an embodiment of the hydrocarbon system 10 of FIGS. 1-5, further illustrating the torque tool 28 coupled to the running tool 12 and the torque tool assembly 206 of the pressure cap assembly 18 for actuation of the clamp assembly 154. As illustrated in FIG. 6, the torque tool 28 is coupled to the tool engagement bracket 176 with the alignment pins 198 disposed in the alignment slots 190 of the bowtie body 178, and the torque tool interface 196 is engaged with the torque tool interface 30 as discussed above. As further illustrated in FIG. 6, the running tool 12 has been actuated to move (e.g., axially stroke) the pressure cap assembly 18 from the axially offset position 366 as shown in FIG. 5 to the axially aligned position 368 with the pressure cap 200 disposed against the hub 82 and the clamp assembly 154 disposed about the hub 82 (e.g., concentric with the hub 82). In the axially aligned position 368, the torque tool 28 may be operated to rotate the threaded rod 234, which is threaded within the threaded connectors 218 and 220 of the clamp assembly 154. As the threaded rod 234 rotates, the clamp segments 208 and 210 are driven radially toward one another about the central axis 48, thereby moving the clamp segments 208 and 210 to engage with the annular groove 298 in the hub 82 and extend around the annular flange 302 of the hub 82 and the annular lip 386 of the pressure cap 200. As illustrated in FIG. 6, the clamp assembly 154 is shown in an expanded or unlocked position 400 of the clamp assembly 154 prior to actuation by the torque tool 28. In particular, the unlocked position 400 has the clamp segments 208 and 210 in radially expanded positions that do not lock the pressure cap 200 onto the hub 82.

Figure 7:
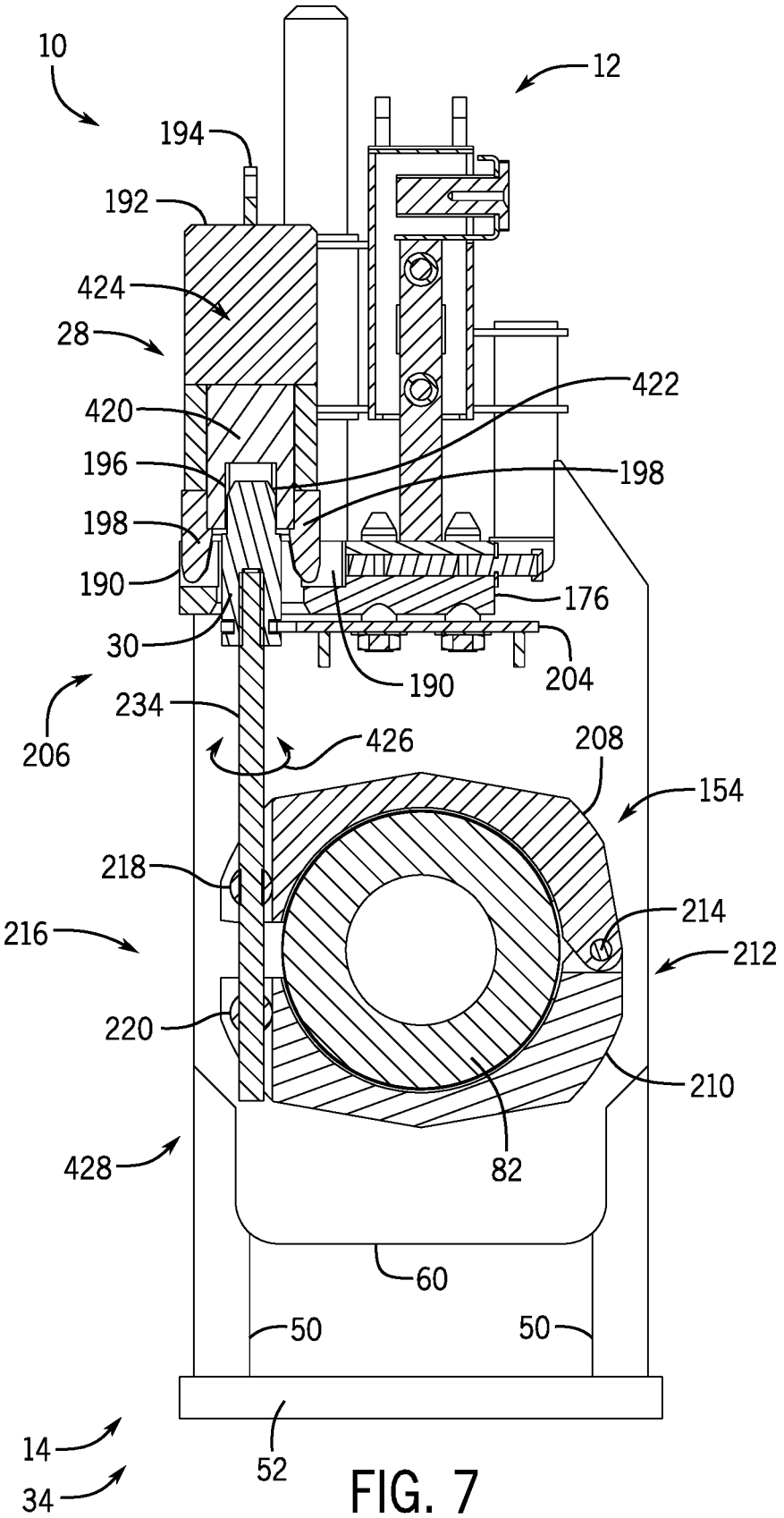
FIG. 7 is a cross-sectional view of an embodiment of the hydrocarbon system of FIGS. 1-6, taken through a plane as indicated by line or section 7-7 in FIG. 6, further illustrating details of the torque tool coupled to the running tool and the torque tool assembly of the pressure cap assembly for actuation of the clamp assembly.

FIG. 7 is a cross-sectional view of an embodiment of the hydrocarbon system 10 of FIGS. 1-6, taken through a plane as indicated by line or section 7-7 in FIG. 6, further illustrating details of the torque tool 28 coupled to the running tool 12 and the torque tool assembly 206 of the pressure cap assembly 18 for actuation of the clamp assembly 154. As illustrated, the torque tool 28 is engaged with the tool engagement bracket 176 with the alignment pins 198 disposed within the alignment slots 190 in the bowtie body 178, while the torque tool interface 196 is engaged with the torque tool interface 30 of the pressure cap assembly 18. In the illustrated embodiment, the torque tool interface 196 is a female torque tool interface, while the torque tool interface 30 is a male torque tool interface. In particular, the torque tool interface 30 has the post 258 with the plurality of flats 260 (e.g., defining square shaped post) as discussed above with reference to FIG. 2. The torque tool interface 196 of the torque tool 28 includes a receptacle 420 having a plurality of interior flats 422 (e.g., defining square shaped receptacle), which are configured to engage with the corresponding flats 260 disposed on the post 258 of the torque tool interface 30. The torque tool interface 196 is further coupled to a drive 424, which is configured to rotate the torque tool interface 196 to cause rotation of the threaded rod 234 of the torque tool assembly 206 of the pressure cap assembly 18. The drive 424 may include a local drive disposed in the body 198 of the torque tool 28 and/or a remote drive, which transfers torque through a line connected to the tool line connector 194. For example, the drive 424 may include an electric drive, a hydraulic drive, a pneumatic drive, or any combination thereof. Additionally or alternatively, the drive 424 may include a transmission, gearing, or a torque transfer assembly configured to transfer torque from the tool line connector 194 to the torque tool interface 196. In certain embodiments, the tool line connector 194 and/or other connectors (e.g., ROV connectors) may be removably coupled to an ROV for operation of the torque tool 28.

In operation, the torque tool 28 is configured to rotate the threaded rod 234 in a clockwise or counter-clockwise rotational direction as indicated by arrow 426. The rotational direction 426 determines whether the clamp assembly 154 expands or contracts about the pressure cap 200 and the hub 82. In the illustrated embodiment, the clamp assembly 154 is shown in a locked position 428 about the hub 82 and the pressure cap 200. Again, as the threaded rod 234 rotates, the threaded rod 234 moves within the threaded connectors 218 and 220 of the clamp segments 208 and 210, thereby causing the clamp segments 208 and 210 to pivot about the pin 214 of the pivot joint 212 as the threaded connectors 218 and 220 move toward or away from one another. If the threaded rod 234 drives the threaded connectors 218 and 220 toward one another, then the clamp segments 208 and 220 of the clamp assembly 154 radially compress or contract from the unlocked position 368 of FIG. 6 to the locked position 428 of FIG. 7. If the threaded rod 234 drives the threaded connectors 218 and 220 away from one another, then the clamp segments 208 and 220 of the clamp assembly 154 radially expand from the locked position 428 of FIG. 7 to the unlocked position 368 of FIG. 6. After the clamp assembly 154 is actuated by the torque tool 28 to contract about the hub 82 and the pressure cap 200 to move into the locked position 428, the torque tool 28 may be retrieved followed by retrieval of the running tool 12. Thus, once the torque tool 28 and the running tool 12 are retrieved, the pressure cap assembly 18 remains coupled to the tubing connector 34 via the locked position 428 of the clamp assembly 154. Advantageously, the running tool 12 and the torque tool 28 are not integrally formed with the pressure cap assembly 18, thereby reducing the overall space consumption of the pressure cap assembly 18 and enabling use of the same running tool 12 and/or torque tool 28 for other installation and retrieval procedures for other pressure cap assemblies and equipment. Prior to or after the foregoing installation procedure, the fluid system 16 may be lowered and aligned with the fluid system 14 as discussed below.

Figure 8:
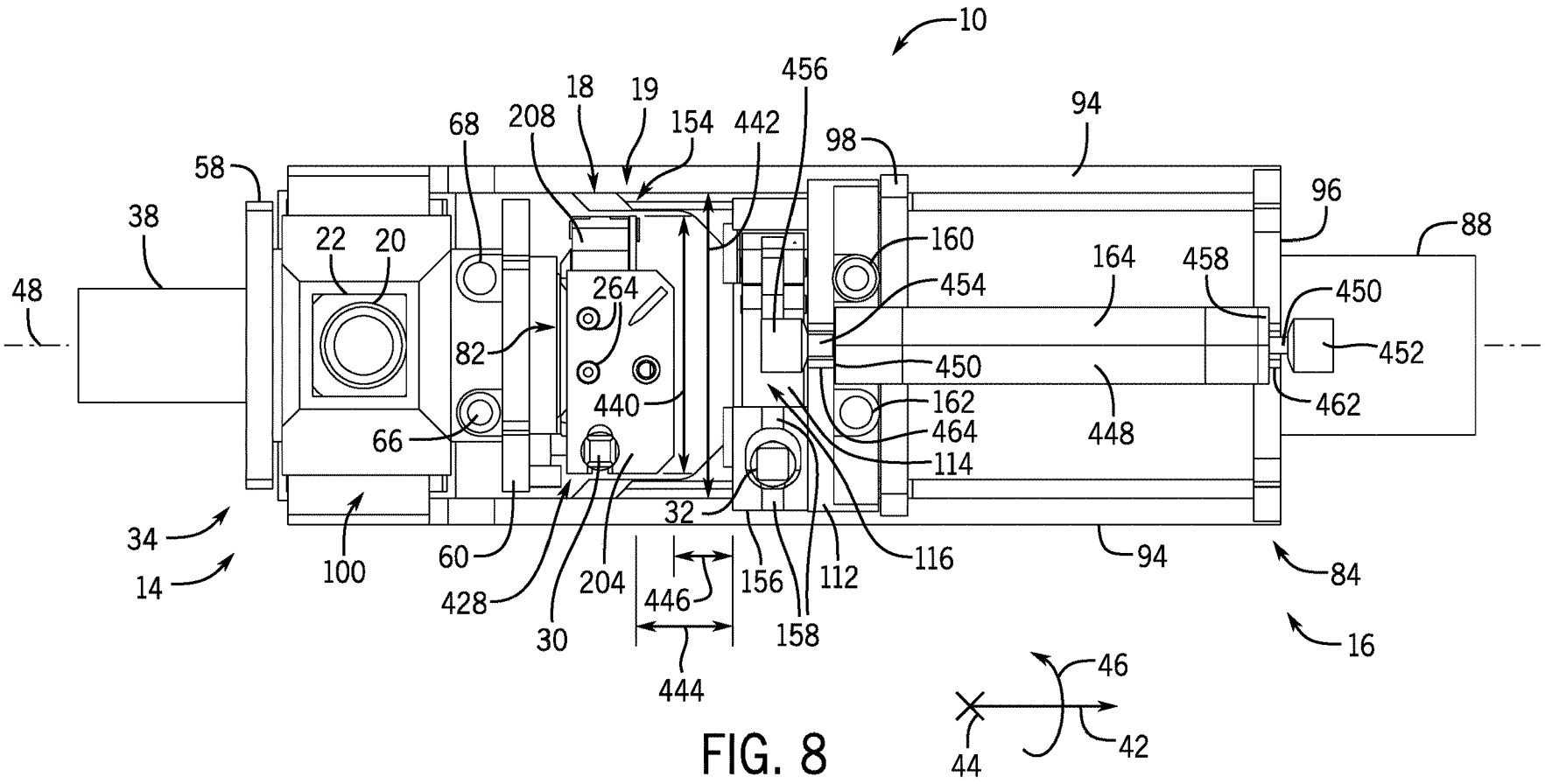
FIG. 8 is a top view of an embodiment of the hydrocarbon system of FIGS. 1-7, further illustrating the first fluid system aligned and coupled with the second fluid system with a window for operating the running tool.

FIG. 8 is a top view of an embodiment of the hydrocarbon system 10 of FIGS. 1-7, further illustrating the fluid system 16 aligned and coupled with the fluid system 14 with the window 19 for operating of the running tool 12. As discussed above, when aligning and coupling the fluid systems 14 and 16, the guide pins 24 of the tubing connector 84 are aligned with and disposed into the guide slots 26 in the tubing connector 34 and the alignment post 20 of the tubing connector 34 extends through the alignment opening 22 of the tubing connector 84. As illustrated in FIG. 8, when the fluid systems 14 and 16 are coupled together, the window 19 allows for the installation and removal of the pressure cap assembly 18 via the running tool 12 and the torque tool 28 as discussed in detail above. Advantageously, the window 19 provides sufficient lateral space for the running tool 12 and the pressure cap assembly 18 between the side plates 94 of the support base 92 of the tubing connector 84, while also providing sufficient axial space for the running tool 12 and the pressure cap assembly 18 between the hub 82 of the tubing connector 34 and the hub 114 of the tubing connector 84. Accordingly, the running tool 12 may be removably coupled to the pressure cap assembly 18 and moved through the window 19, such that the running tool 12 can raise and lower the pressure cap assembly 18 as illustrated in FIGS. 3 and 4, and the running tool 12 can move (e.g., axially stroke) the pressure cap assembly 18 along the central axis 48 as illustrated in FIGS. 5 and 6 during an installation or removal procedure.

The dimensions of the window 19 are larger than both the running tool 12 and the pressure cap assembly 18, including a range of axial movement as shown in FIGS. 5 and 6. For example, a width 440 of the running tool 12 and coupled pressure cap assembly 18 is less than a width 442 between the side plates 94 of the tubing connector 84. By further example, the width 440 may be less than or equal to 70, 75, 80, 85, 90, 95, 96, 97, 98, or 99 percent of the width 442. Therefore, a clearance exists between the running tool 12 and coupled pressure cap assembly 18 and the side plates 94 to facilitate vertical and horizontal movement of the pressure cap assembly 18 within the window 19 during installation and removal using the running tool 12 and the torque tool 28. The window 19 also may provide an axial distance 444 between the hubs 82 and 114, such that an axial clearance 446 remains between the pressure cap assembly 18 and the hub 114 after installation of the pressure cap assembly 18 on the hub 82. Accordingly, the axial clearance 446 provides sufficient space for the running tool 12 to move (e.g., axially stroke) the pressure cap assembly 18 along the central axis 48 when installing and removing the pressure cap assembly 18, as illustrated in FIGS. 5 and 6. Thus, the fluid system 16 can remain coupled to the fluid system 14, while still allowing for the installation and removal of the pressure cap assembly 18 via the running tool 12 and the torque tool 28. The dimensions and profile of the running tool 12 are configured to work within the window 19, thereby allowing for such installation and removal when maintaining the connection between the fluid systems 14 and 16. Thus, the tubing 88 and the hub 114 of the tubing connector 84 (e.g., a jumper) may remain in a wet parked position during the installation and/or removal procedures for the pressure cap assembly 18 using the running tool 12 and the torque tool 28.

As further illustrated in FIG. 8, the tool 164 is coupled to the plates 96 and 98 of the body 86 of the tubing connector 84, while still enabling operation of the running tool 12 to install or retrieve the pressure cap assembly 18. The tool 164 includes a body 448 having a shaft 450 extending to an enlarged head 452, and a shaft 454 extending to an enlarged head 456 on opposite axial ends 458 and 460 of the body 448. The shaft 450 is configured to removably extend into an axial slot 462 in the plate 96, while the shaft 454 is configured to extend into an axial slot 464 in the drive plate 112. The enlarged heads 452 and 456 are configured to block axial movement of the tool 164 relative to the axial slots 462 and 464. In particular, the plate 96 is disposed between the body 448 and the enlarged head 452, while the axial slot 462 and the shaft 450 are smaller than the widths of the body 448 and the enlarged head 452. Similarly, the plate 112 is disposed between the body 448 and the enlarged head 456, while the axial slot 464 and the shaft 454 are sized smaller than the widths of the body 448 and the enlarged head 456. In operation, the tool 164 is configured to drive axial movement of the hub 114 and the clamp assembly 116 via movement of the drive plate 112. Accordingly, the tool 164 may be used to connect the hub 116 with the hub 82 of the tubing connector 34. The clamp assembly 116 is driven by the torque tool 28 to expand and contract about the hubs 82 and 114 in a similar manner as described in detail above with reference to the clamp assembly 154 of the pressure cap assembly 18.

Figure 9:
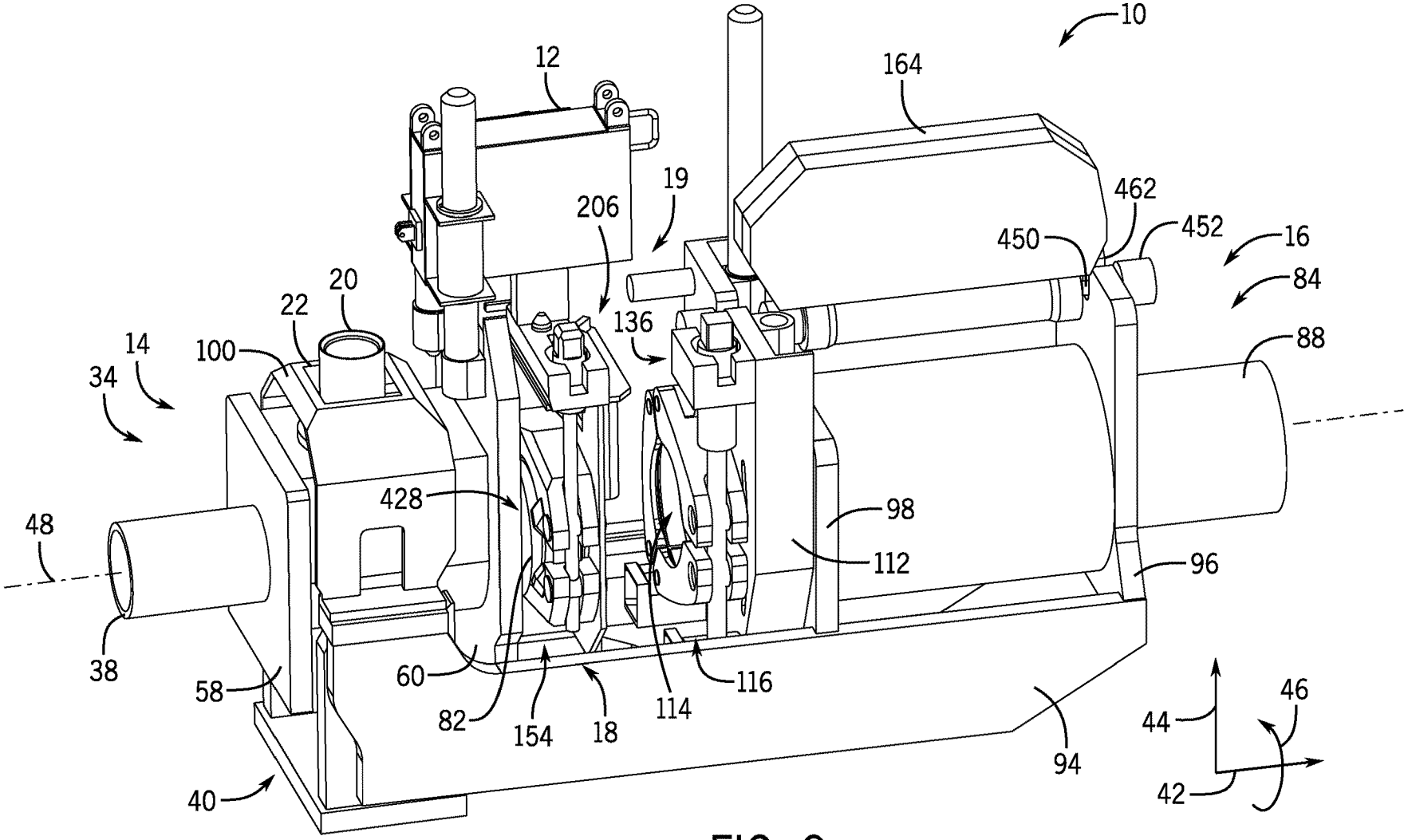
FIG. 9 is a perspective view of an embodiment of the hydrocarbon system of FIGS. 1-8, further illustrating the first and second fluid systems coupled together, the running tool coupled to the first fluid system and the pressure cap assembly, and the pressure cap assembly in a locked position about the hub.

FIG. 9 is a perspective view of an embodiment of the hydrocarbon system 10 of FIGS. 1-8, further illustrating the fluid systems 14 and 16 coupled together, the running tool 12 coupled to the fluid system 14 and the pressure cap assembly 18, and the pressure cap assembly 18 in the locked position 428 about the hub 82. As illustrated, the window 19 enables for the pressure cap assembly 18 to be installed and removed by the running tool 12 and the torque tool 28, because there is sufficient room in the axial direction 42 and the lateral direction between the side plates 94 as discussed above. While operating the running tool 12 to install or remove the pressure cap assembly 18, the tool 164 also may be coupled to the fluid system 16 for readiness to move (e.g., axially stroke) the hub 114. Thus, the fluid system 16 does not need to be separated from the fluid system 14 to enable operation and use of the running tool 12 for installation and removal of the pressure cap assembly 18. Additionally, the tool 164 can be installed and remain in place during use of the running tool 12.

Figure 10:
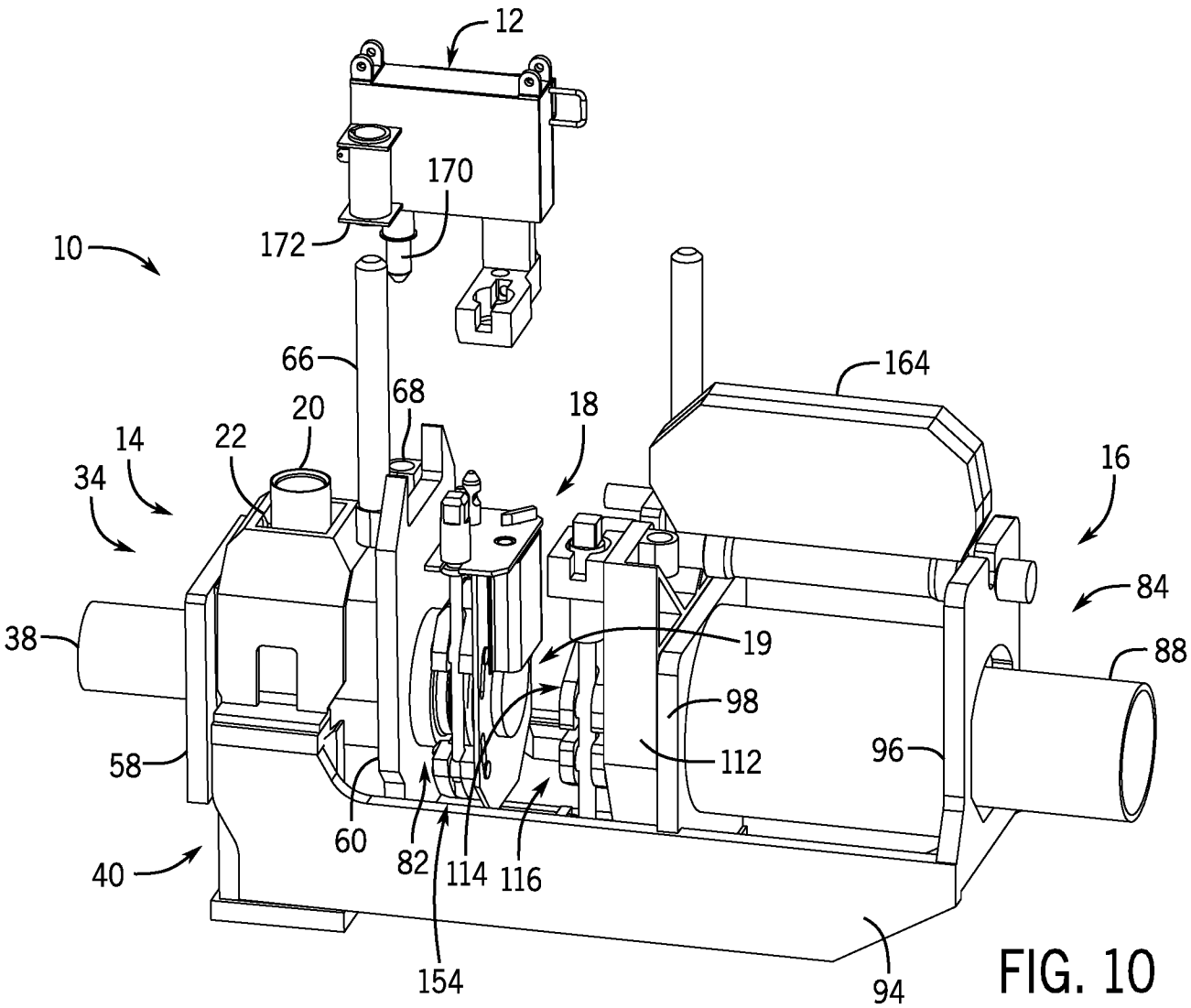
FIG. 10 is a perspective view of an embodiment of the hydrocarbon system of FIGS. 1-9, further illustrating the running tool separate from the pressure cap assembly while the pressure cap assembly is installed to the first fluid system and the first and second fluid systems are coupled together.

FIG. 10 is a perspective view of an embodiment of the hydrocarbon system 10 of FIGS. 1-9, further illustrating the running tool 12 separate from the pressure cap assembly 18 while the pressure cap assembly 18 is installed to the fluid system 14 and the fluid systems 14 and 16 are coupled together. As illustrated, the window 19 provides sufficient space for the vertical raising and lowering of the running tool 12 with or without the pressure cap assembly 18. For example, for an installation procedure, the running tool 12 can lower the pressure cap assembly 18 into the window 19 between the fluid systems 14 and 16, actuate the pressure cap assembly 18 to connect with the hub 82 of the fluid system 14, disconnect from the pressure cap assembly 18, and then raise away from the pressure cap assembly 18. By further example, for a removal procedure, the running tool 12 can lower into the window 19 between the fluid systems 14 and 16, connect with the pressure cap assembly 18, actuate the pressure cap assembly 18 to disconnect from the hub 82 of the fluid system 14, and then lift upwardly with the pressure cap assembly 18 coupled to the running tool 12. For the actuation of the pressure cap assembly 18, the running tool 12 and the pressure cap assembly 18 have sufficient space within the window 19 for axial movement (e.g., axial stroking) of the pressure cap assembly 18 to engage or disengage the pressure cap 200 with the hub 82. Thus, the fluid system 16, which may include a jumper or other tubing arrangements, may remain in a wet park position during the installation or removal of the pressure cap assembly 18 using the running tool 12 and torque tool 28.

Figure 11:
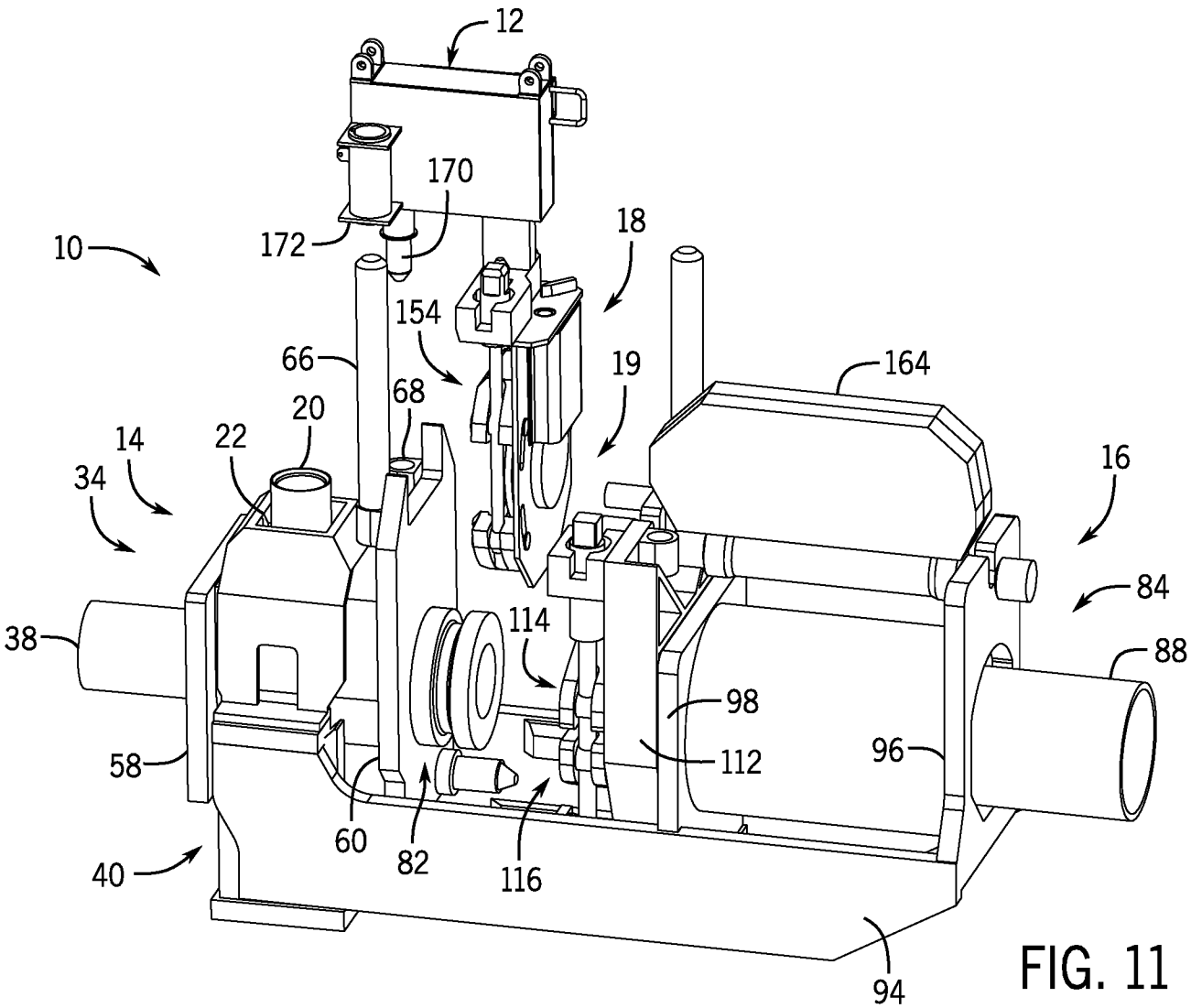
FIG. 11 is a perspective view of an embodiment of the hydrocarbon system of FIGS. 1-10, further illustrating the running tool installing or removing the pressure cap assembly within the window while the first and second fluid systems are coupled together.

FIG. 11 is a perspective view of an embodiment of the hydrocarbon system 10 of FIGS. 1-10, further illustrating the running tool 12 in the process of installing or removing the pressure cap assembly 18 within the window 19 while the fluid systems 14 and 16 are coupled together. As illustrated, the window 19 provides sufficient space for the vertical raising and lowering of the pressure cap assembly 18 and the running tool 12 and also sufficient space for axial movement (e.g., axial stroking) of the pressure cap assembly 18 to engage or disengage the pressure cap 200 with the hub 82. Thus, the fluid system 16, which may include a jumper or other tubing arrangements, may remain in a wet park position during the installation or removal of the pressure cap assembly 18 using the running tool 12 and torque tool 28.

Technical effects of the disclosed embodiments of the running tool 12, the torque tool 28, and the pressure cap assembly 18 reduce the space consumption needed for installation or removal of the pressure cap assembly 18, while also enabling the running tool 12 and the torque tool 28 to be removed and used elsewhere for other procedures. The running tool 12 and the torque tool 28 may be mounted vertically above the pressure cap assembly 18, thereby reducing or minimizing the horizontal space consumption or footprint of the coupled components (e.g., tools 12 and 28 and pressure cap assembly 18) for fitting into small spaces (e.g., a window 19 between fluid systems 14 and 16). The pressure cap assembly 18 also may be installed and removed through the window 19 while the fluid systems 14 and 16 are coupled together and the tool 164 is coupled to the fluid system 16, such as when a horizontal jumper of the fluid system 16 is disposed in a wet park position. Thus, the pressure cap assembly 18 can be installed by the tools (e.g., running tool 12 and torque tool 28) without separating or moving apart the fluid systems 14 and 16, without removing or moving the tool 164, and while the horizontal jumper is in the wet park position. The guide features (e.g., alignment posts, alignment bores, alignment slots, alignment pins, etc.) of the fluid systems 14 and 16, the running tool 12, the torque tool 28, and the pressure cap assembly 18 also help improve the connections, speed up the process of connecting and disconnecting, reduce the need for ROV operations, and improve the accuracy of the installation and removal of the pressure cap assembly 18.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A system, comprising:

a running tool, comprising:

a carrier having an axial drive;

an arm coupled to the axial drive; and a tool engagement bracket coupled to the arm, wherein the tool engagement bracket is configured to couple to a pressure cap assembly having a clamp assembly disposed about a pressure cap, and the tool engagement bracket comprises a torque tool opening configured to enable engagement of a torque tool with the clamp assembly;

wherein the axial drive is configured to move the arm, the tool engagement bracket, and the pressure cap assembly along an axial path of travel along a central axis of the pressure cap, wherein the running tool is configured for at least one of:

installation or removal of the pressure cap assembly within a window of a hydrocarbon system having first and second fluid systems removably coupled together; or removably coupling to the pressure cap assembly.

2. The system of claim 1, wherein the tool engagement bracket comprises a tool lock assembly configured to removably couple the running tool to the pressure cap assembly, wherein the running tool is separate from the torque tool.

3. The system of claim 1, wherein the running tool is configured to install or remove the pressure cap assembly within the window of the hydrocarbon system having the first and second fluid systems removably coupled together, the first fluid system comprises a first tubing connector having a first hub coupled to a first tubing, the second fluid system comprises a second tubing connector having a second hub coupled to a second tubing, the window is disposed axially between the first and second hubs, the first hub is an inboard hub, and the second hub is an outboard hub.

4. The system of claim 3, wherein the first and second fluid systems are configured to couple or uncouple relative to one another while the pressure cap assembly is coupled to the first hub, wherein the window is sized with clearance to enable movement of the pressure cap assembly during actuation by the running tool and the torque tool to install and remove the pressure cap assembly.

5. The system of claim 3, comprising the first and second fluid systems, wherein the first fluid system comprises a first alignment guide configured to couple with a second alignment guide of the second fluid system, and a tool is configured to couple with the second fluid system to axially move the second hub toward the first hub, wherein the running tool is configured to install and remove the pressure cap assembly within the window while the tool is coupled to the second fluid system.

6. The system of claim 1, wherein the axial drive comprises a piston cylinder assembly having a piston disposed in a cylinder.

7. The system of claim 1, wherein the carrier comprises an axial guide assembly having an axial guide bore disposed in the arm and an axial guide bar extending through the axial guide bore.

8. The system of claim 1, wherein the carrier comprises an axial slot, and the arm is configured to move along the axial slot in response to the axial drive.

9. The system of claim 1, wherein the tool engagement bracket comprises an alignment guide configured to engage with a mating alignment guide of the pressure cap assembly.

10. The system of claim 9, wherein the alignment guide comprises one or more alignment bores, and the mating alignment guide comprises one or more alignment pins.

11. The system of claim 10, wherein tool lock assembly comprises a locking rod extending through a rod bore in the tool engagement bracket, the locking rod includes a lock release slot configured to align with each of the one or more alignment pins, and each of the one or more alignment pins includes a locking slot configured to lock with the locking rod.

12. The system of claim 1, wherein the tool engagement bracket comprises an alignment guide configured to engage with a mating alignment guide of the torque tool.

13. The system of claim 1, wherein the running tool comprises an alignment guide coupled to the carrier, wherein the alignment guide is configured to couple with a mating alignment guide of a fluid system having a hub coupled to a tubing, wherein the alignment guide comprises an alignment post configured to couple with a mating alignment bore of the mating alignment guide, the alignment guide comprises an alignment bore configured to couple with a mating alignment post of the mating alignment guide, or a combination thereof.

14. The system of claim 1, comprising the pressure cap assembly, wherein the pressure cap assembly comprises:

the pressure cap;

the clamp assembly disposed about the pressure cap, wherein the clamp assembly comprises a plurality of clamp segments movably coupled together;

a torque tool assembly coupled to the clamp assembly, wherein the torque tool assembly comprises a rod coupled to a torque tool interface configured to removably couple with the torque tool, wherein the rod is configured to drive the plurality of clamp segments to expand or contract about the pressure cap and a hub of a tubing connector in response to a torque applied by the torque tool; and a tool interface plate configured to removably couple with the tool engagement bracket of the running tool.

15. A system, comprising:

a hydrocarbon system, comprising:

a first fluid system comprising a first tubing connector having a first hub coupled to a first tubing;

a second fluid system comprising a second tubing connector having a second hub coupled to a second tubing, wherein the first and second fluid systems are configured to removably couple together;

a pressure cap assembly comprising:

a pressure cap;

a clamp assembly disposed about the pressure cap, wherein the clamp assembly comprises a plurality of clamp segments movably coupled together;

a torque tool assembly coupled to the clamp assembly, wherein the torque tool assembly comprises a rod coupled to a torque tool interface configured to removably couple with a torque tool, wherein the rod is configured to drive the plurality of clamp segments to expand or contract about the pressure cap and the first hub in response to a torque applied by the torque tool; and a tool interface plate configured to removably couple with a tool engagement bracket of a running tool having an axial drive, wherein the axial drive is configured to move the pressure cap assembly along an axial path of travel along a central axis of the pressure cap, wherein the pressure cap assembly, the running tool, and the torque tool are separate and configured to removably couple together; and a window disposed axially between the first and second hubs, wherein the window is configured to enable at least one of:

installation or removal of the pressure cap assembly relative to the first hub while the first and second fluid systems are coupled together; or coupling together of the first and second fluid systems while the pressure cap assembly is installed on the first hub.

16. The system of claim 15, wherein the first hub comprises an inboard hub and the second hub comprises an outboard hub, the inboard hub faces the outboard hub, the window is configured to enable the installation or removal of the pressure cap assembly relative to the first hub while the first and second fluid systems are coupled together, and the window is configured to enable coupling together of the first and second fluid systems while the pressure cap assembly is installed on the first hub.

17. A method, comprising:

configuring a first fluid system, a second fluid system, and a pressure cap assembly of a hydrocarbon system, wherein the first fluid system comprises a first tubing connector having a first hub coupled to a first tubing, wherein the second fluid system comprises a second tubing connector having a second hub coupled to a second tubing, wherein the first and second fluid systems are configured to removably couple together, wherein the pressure cap assembly comprises:

a pressure cap;

a clamp assembly disposed about the pressure cap, wherein the clamp assembly comprises a plurality of clamp segments movably coupled together;

a torque tool assembly coupled to the clamp assembly, wherein the torque tool assembly comprises a rod coupled to a torque tool interface configured to removably couple with a torque tool, wherein the rod is configured to drive the plurality of clamp segments to expand or contract about the pressure cap and the first hub in response to a torque applied by the torque tool; and a tool interface plate configured to removably couple with a tool engagement bracket of a running tool having an axial drive, wherein the axial drive is configured to move the pressure cap assembly along an axial path of travel along a central axis of the pressure cap, wherein the pressure cap assembly, the running tool, and the torque tool are separate and configured to removably couple together, and wherein a window is disposed axially between the first and second hubs and configured to enable at least one of:

installation or removal of the pressure cap assembly relative to the first hub while the first and second fluid systems are coupled together; or coupling together of the first and second fluid systems while the pressure cap assembly is installed on the first hub.

18. The method of claim 17, wherein the window is configured to enable the installation or removal of the pressure cap assembly relative to the first hub while the first and second fluid systems are coupled together.

19. The method of claim 17, wherein the window is configured to enable the coupling together of the first and second fluid systems while the pressure cap assembly is installed on the first hub.

* * * * *